US007076898B1

(12) United States Patent
Hunt

(10) Patent No.: US 7,076,898 B1
(45) Date of Patent: Jul. 18, 2006

(54) METHOD AND APPARATUS FOR FENCE ADVERTISEMENT

(76) Inventor: Randall C. Hunt, 129 Kortney Dr., Weatherford, TX (US) 76087

( * ) Notice: Subject to any disclaimer, the term of this patent is extended or adjusted under 35 U.S.C. 154(b) by 0 days.

(21) Appl. No.: 10/925,157

(22) Filed: Aug. 24, 2004

Related U.S. Application Data

(60) Provisional application No. 60/497,868, filed on Aug. 26, 2003.

(51) Int. Cl.
*G09F 7/02* (2006.01)

(52) U.S. Cl. ..... 40/611.01; 40/583; 40/550; 40/607.15; 40/622; 256/32; 256/33

(58) Field of Classification Search ..... 40/611.01, 40/602, 583, 550, 584, 582, 607.15, 622; 256/32, 33
See application file for complete search history.

(56) References Cited

U.S. PATENT DOCUMENTS

| | | | | | |
|---|---|---|---|---|---|
| 507,952 | A * | 10/1893 | White | 40/583 |
| 955,745 | A * | 4/1910 | Bailey | 40/622 |
| 1,050,115 | A * | 1/1913 | Ellison | 40/622 |
| 1,064,897 | A * | 6/1913 | Gabet | 40/583 |
| 2,078,926 | A * | 5/1937 | Cornell et al. | 40/596 |
| 2,902,786 | A * | 9/1959 | Schneider | 40/623 |
| 3,206,882 | A * | 9/1965 | Thatcher | 40/613 |
| 3,774,884 | A * | 11/1973 | Singer | 256/32 |
| 3,964,197 | A * | 6/1976 | Tucker et al. | 40/584 |
| 4,582,284 | A * | 4/1986 | Veenstra | 248/220.21 |
| 4,607,444 | A * | 8/1986 | Foster | 40/550 |
| 4,651,975 | A * | 3/1987 | Howell | 256/32 |
| 5,177,890 | A * | 1/1993 | Hisatomi et al. | 40/447 |
| 5,342,021 | A * | 8/1994 | Watson | 256/1 |
| 5,441,239 | A * | 8/1995 | Watson | 256/1 |
| 6,266,904 | B1 * | 7/2001 | Zheng | 40/604 |
| 6,669,175 | B1 * | 12/2003 | Snow et al. | 256/32 |
| 2004/0261304 | A1 * | 12/2004 | Edwards | 40/611.01 |

* cited by examiner

*Primary Examiner*—Gary C. Hoge
(74) *Attorney, Agent, or Firm*—Hill Law Firm

(57) ABSTRACT

A system is provided to allow one to utilize fences in order to display text and designs. This is suitable for advertising applications. This is also suitable to make chain-link fences into privacy fences. The apparatus is an insert which may be snapped into position relative to fence components such as a chain-link fence. It includes a display plate, a plurality of side plates, a lower lip, and at least one latch member. Preferably, all of these components are integrally formed into one piece. The insert snaps into position relative to the components of a chain-link fence. The inserts may be colored. The inserts may carry lighting elements. The inserts may carry translucent portions. The inserts may carry reflective components. The inserts may carry movable components. The inserts may carry cut-out portions. Additionally, an internet-moderated method is disclosed which allows for customers to provide their design information and requirements. The system automatically generates a purchase order with the correct type and number of inserts. The system also automatically generates instructions and/or graphics which facilitate the installation of the insert by the customer.

18 Claims, 25 Drawing Sheets

Step 1: Grip the cup between your thumb and middle finger.

Step 2: While squeezing the cup together, insert cup into fence.

Step 3: Depress the middle of the cup to snap it into place.

Step 4: Make sure that the top left and bottom right tabs are securely fastened to your fence.

METHOD AND APPARATUS FOR FENCE ADVERTISEMENT

CLAIM OF PRIORITY

This application claims the benefit of U.S. Provisional Patent Application Ser. No. 60/497,868, filed 26 Aug. 2003, entitled "METHOD AND APPARATUS FOR FENCE ADVERTISEMENT." This provisional application is incorporated herein as if fully set forth.

BACKGROUND OF THE INVENTION

1. Field of the Invention

The present invention relates to devices which may be utilized to place advertisements and/or decorative elements on fences. It includes individual elements which may be colored differently in order to allow textual messages and/or designs to be displayed. This makes for a very effective advertising use. Additionally, as the inserts completely fill the space between the wire mesh of a chain-link fence, the inserts can be utilized to turn an ordinary chain-link fence into a "privacy" fence. The inserts can also be utilized to reduce noise in the region of a fence. The inserts can also make a chain-link fence more secure, as the fence is more difficult to climb with the inserts in place.

2. Description of the Prior Art

In general, advertising is quite expensive. For many types of businesses, signage located at the place of business is the most effective form of advertisement. However, zoning and other regulatory restrictions such as restrictive covenants and air and light easements may make the use of billboard signage difficult or impossible for some businesses. Many businesses have fences which surround the property. One common type of fence is a chain-link fence. The present invention provides a novel apparatus and method which allows ordinary fences such as chain-link fences to be utilized for advertisement purposes.

SUMMARY OF THE INVENTION

It is one objective of the present invention to provide an insert apparatus which may be releasably secured to a fence, such as a chain-link fence, in a manner which allows for the display of text and design components on the fence.

It is another objective of the present invention to provide such an insert which easily secures to the fence by snapping into position, without requiring any special tools or connector elements.

It is yet another objective of the present invention to provide such an insert which includes integrally formed latching elements which provide a secure connection to the adjoining fence, but which can be unlatched with relative ease.

It is yet another objective of the present invention to provide an internet moderated method which allows customers to place orders for such inserts and to receive detailed instructions for the layout of text and design elements relative to the fence.

The foregoing and additional objectives are achieved as follows.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of the preferred embodiment when read in conjunction with the accompanying drawings, wherein:

FIGS. 5 and 6 show how the insert is secured in position relative to the chain-link fence.

DETAILED DESCRIPTION OF THE INVENTION

Figure 1:
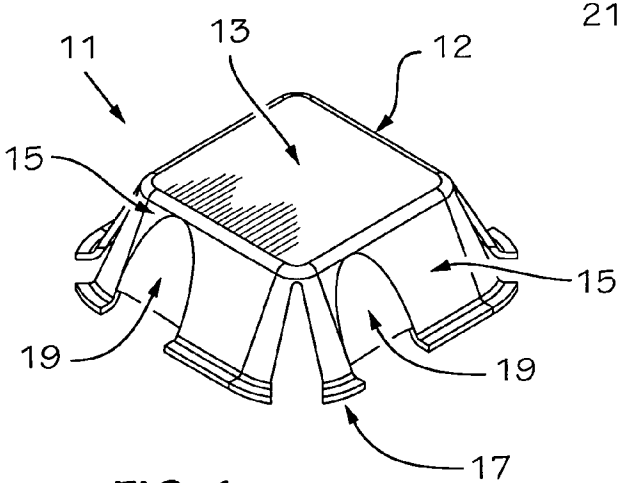
FIG. 1 is a perspective view of the preferred embodiment of the insert of the present invention.

Referring to FIGS. 1–4 in the drawings, an apparatus 11 for fence advertisement according to the present invention is illustrated. In FIG. 1, apparatus 11 is illustrated in a perspective view; in FIG. 2, apparatus 11 is illustrated in a side elevational view; in FIG. 3, apparatus 11 is illustrated in a top plan view; and in FIG. 4, apparatus 11 is illustrated in a bottom view.

Apparatus 11 is generally pan shaped and includes a display plate 12 having an upper surface 13 and an opposing bottom surface 14, a plurality of side plates 15 integrally connected to display plate 12, a lower lip 17 that extends at least partially around the periphery of side plates 15, preferably at an end opposite the end that is connected to display plate 12, and at least one latch member 19 integrally connected to at least one side plate 15.

In the preferred embodiment, four latch members 19 are provided, with one on each side of the apparatus 11, allowing the apparatus 11 to be secured relative to all four surrounding portions of the chain-link fence. In alternative embodiments, a fewer number of latch members may be utilized. For example, having only two latch members 19 on opposing sides of apparatus 11 should provide sufficient support to secure apparatus 11 in place relative to the surrounding portions of the chain-link fence.

Apparatus 11 is preferably made of a rigid but pliable material. Apparatus 11 is preferable manufactured with an injection or drop molded 40 mil polyethylene, preferably PMS colors. Apparatus 11 may also be formed from polypropylene or other suitable material. It will be appreciated that apparatus 11 may be colored, painted, coated, or otherwise treated to produce a wide variety of color effects. For example, apparatus 11 may include transparent coloring, reflective coatings, multiple colorings on different surfaces, and polarized treatments. Preferably, the material includes ultra-violet light protection to prevent the fading of colors.

Figure 2:
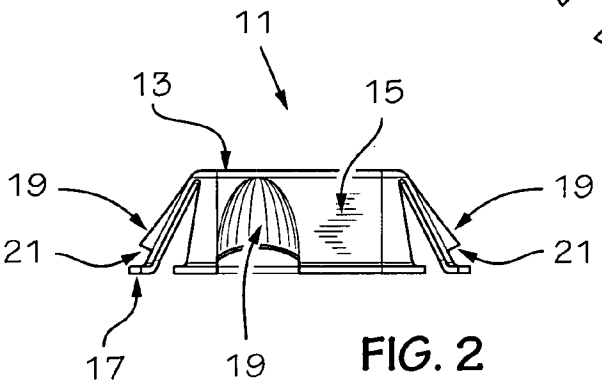
FIG. 2 is a side elevation view of the preferred embodiment of the insert of the present invention.
Figure 4:
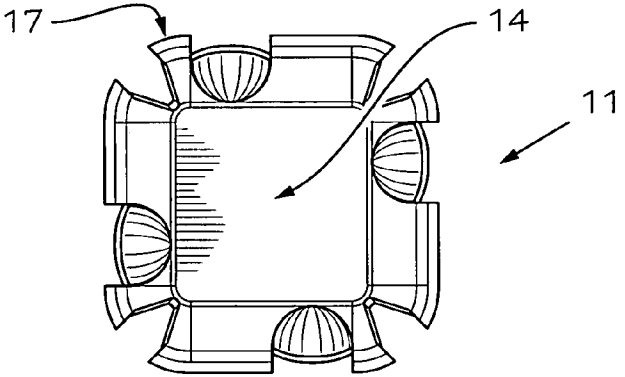
FIG. 4 is a bottom view of the preferred embodiment of the insert of the present invention.

As is best seen in FIG. 2, each latch member 19 protrudes outwardly in a ramp fashion from each corresponding side plate 15. Each latch member 19 is preferably flush with each corresponding side plate 15 at a position near display plate 12, but tapers outwardly a selected distance and terminates with a bottom flange surface 21 that is separated from lower lip 17 a selected distance. This ramp configuration of latch members 19 and the clearance between flange surface 21 and the upper surface of lip member 17 allows apparatus 11 to be releasably secured to a fence, such as a chain link fence.

Figure 5:
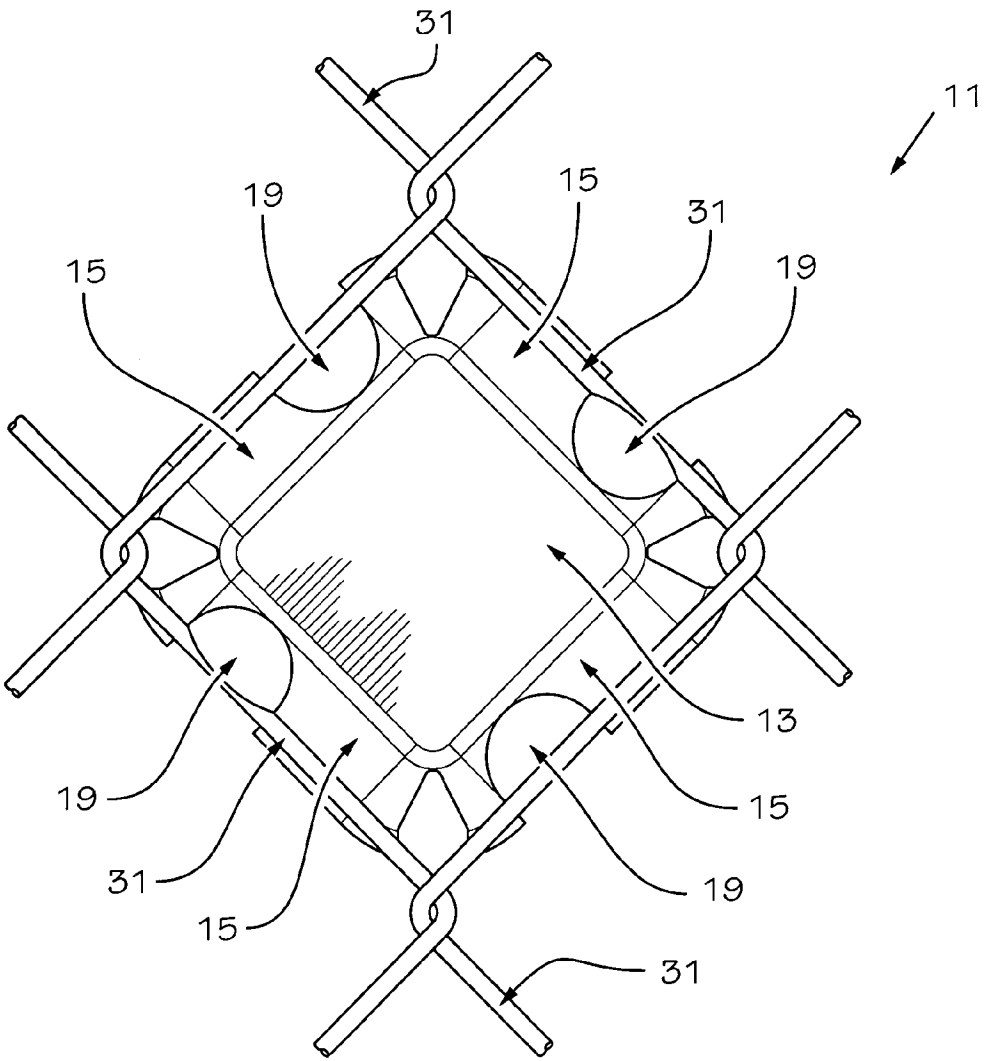
FIG. 5 is a view of one insert installed relative to a chain-link fence.
Figure 6:
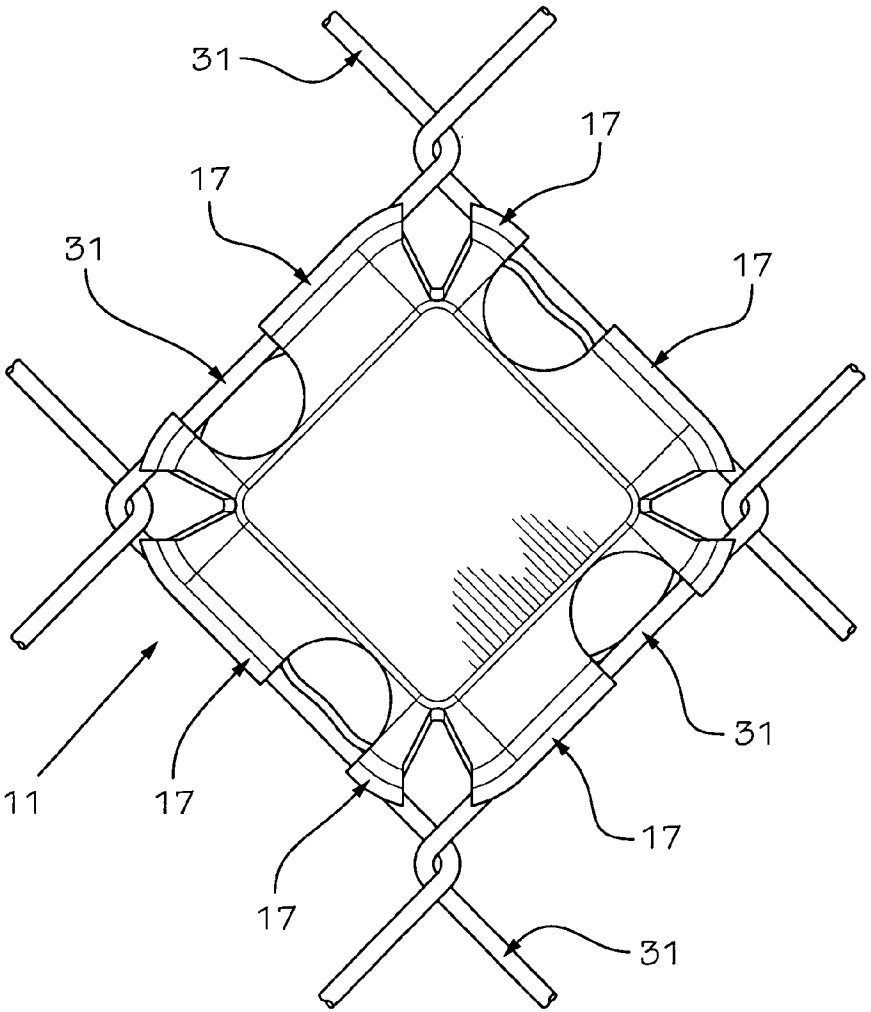
FIG. 6 is a view of the back side of the insert of FIG. 5. Together.

Referring now to FIGS. 5 and 6 in the drawings, apparatus 11 is shown installed in a portion of chain link fence 31. Fence 31 is a conventional interwoven chain link fence; however, it should be understood that apparatus 11 may be used on a wide variety of fence types, such as wire, construction, stockade, picket, slatted, and other types of fences. As is shown, apparatus 11 is dimensioned such that upper surface 13 of display plate 12 fits through the holes in fence 31, but lip 17 does not. In the method of the present invention, apparatus 11 is inserted through a hole in fence 31, such that the wires of fence 31 slide along the ramp portions of latch members 19 until the wires snap into place and are sandwiched between flange surfaces 21 of latch members 19 and lower lip 17. Thus, apparatus 11 is preferably capable of flexing inwardly upon itself to allow apparatus 11 to be snapped into place within a hole in fence 31. It should be understood that latch members 19 on adjacent side plates 15 may be offset somewhat to accommodate the interweaving of the chains in fence 31. In cases where latch members 19 are not offset on adjacent side plates 15, only latch members 19 on opposing side surfaces 15 will fully sandwich the wire of fence 31 between flange surfaces 21 and lower lips 17. In such cases, the wire on the other two side plates 15 will only be in pressing contact with the ramp portions of the corresponding latch members 19.

In a chain-link fence, each opening is defined by four wire strands. Two of the wire strands are in one plane, while the other two wire strands are in another (slightly offset) plane. Accordingly, only two latch members will engage two wire strands in a single plane. The other two latch members will not engage the wire strands.

Figure 3:
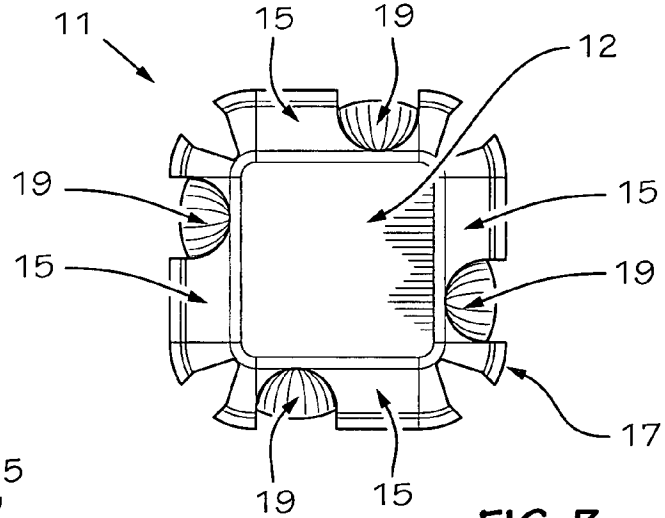
FIG. 3 is a top plan view of the preferred embodiment of the insert of the present invention.
Figure 7:
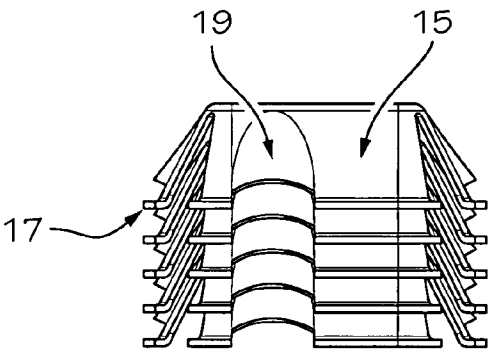
FIG. 7 depicts a number of inserts which are "stacked."

Referring now to FIG. 7 in the drawings, a plurality of apparatuses 11 are shown in a stacking mode. As is shown, side plates 15 are canted inwardly from lower lip 17 toward upper plate 12. This allows a plurality of apparatuses 11 to be interlockingly stacked one upon another. This stacking mode reduces the amount of space necessary to store a large number of apparatuses 11, and provides for ease of transportation, maintenance, sorting, and organization of apparatuses 11. It will be appreciated that a void space may exist behind each ramp portion of each latch member 19 to interlockingly receive the corresponding latch member 19 of the next adjacent understacked apparatus 11.

FIGS. 20A through 30F depict manufacturing drawings for one embodiment of the present invention.

Figure 8:
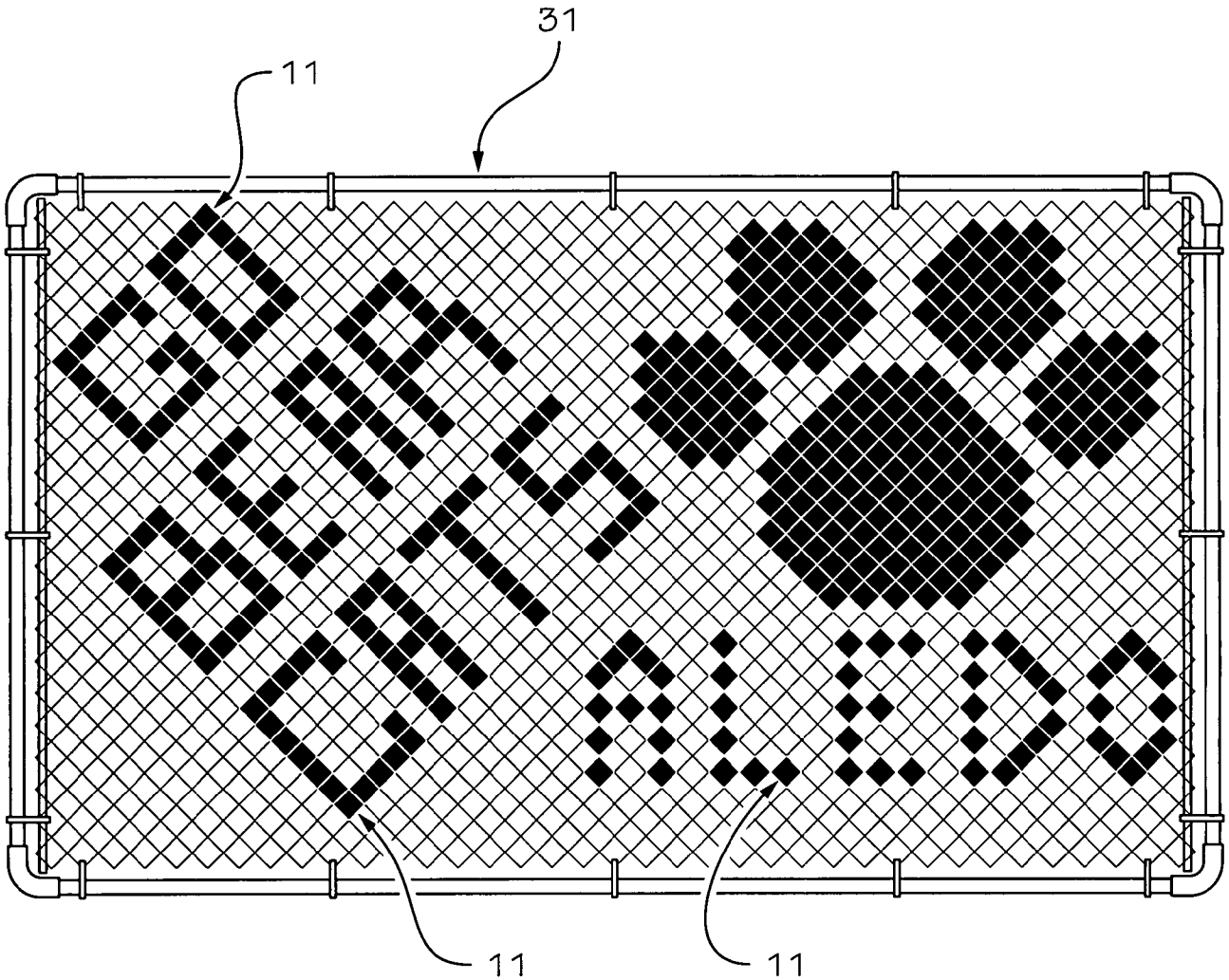
FIG. 8 depicts an example of one particular application of the present invention in order to generate a text message and design on a conventional chain-link fence.

Referring now to FIG. 8 in the drawings, the method of using apparatus 11 as a fence advertisement is illustrated. As is shown, a plurality of apparatuses 11 are inserted into the holes of chain link fence 31. Apparatuses 11 may be placed in the holes of fence 31 to form numbers, text, pictures, and designs. It will be appreciated that an infinite number of promotional messages, advertisements, and warning messages are possible by combining various types and colors of apparatuses 11 together on fence 31.

The apparatus 11 of the present invention may be provided in different sizes to fit different types of chain-link fence. Chain-link fences come in four standard sizes, including: 1¾", 2", 2¼" and 2⅜". A 1¾" chain-link fence is typically the size of a fence utilized in tennis court fencing.

Figure 9:
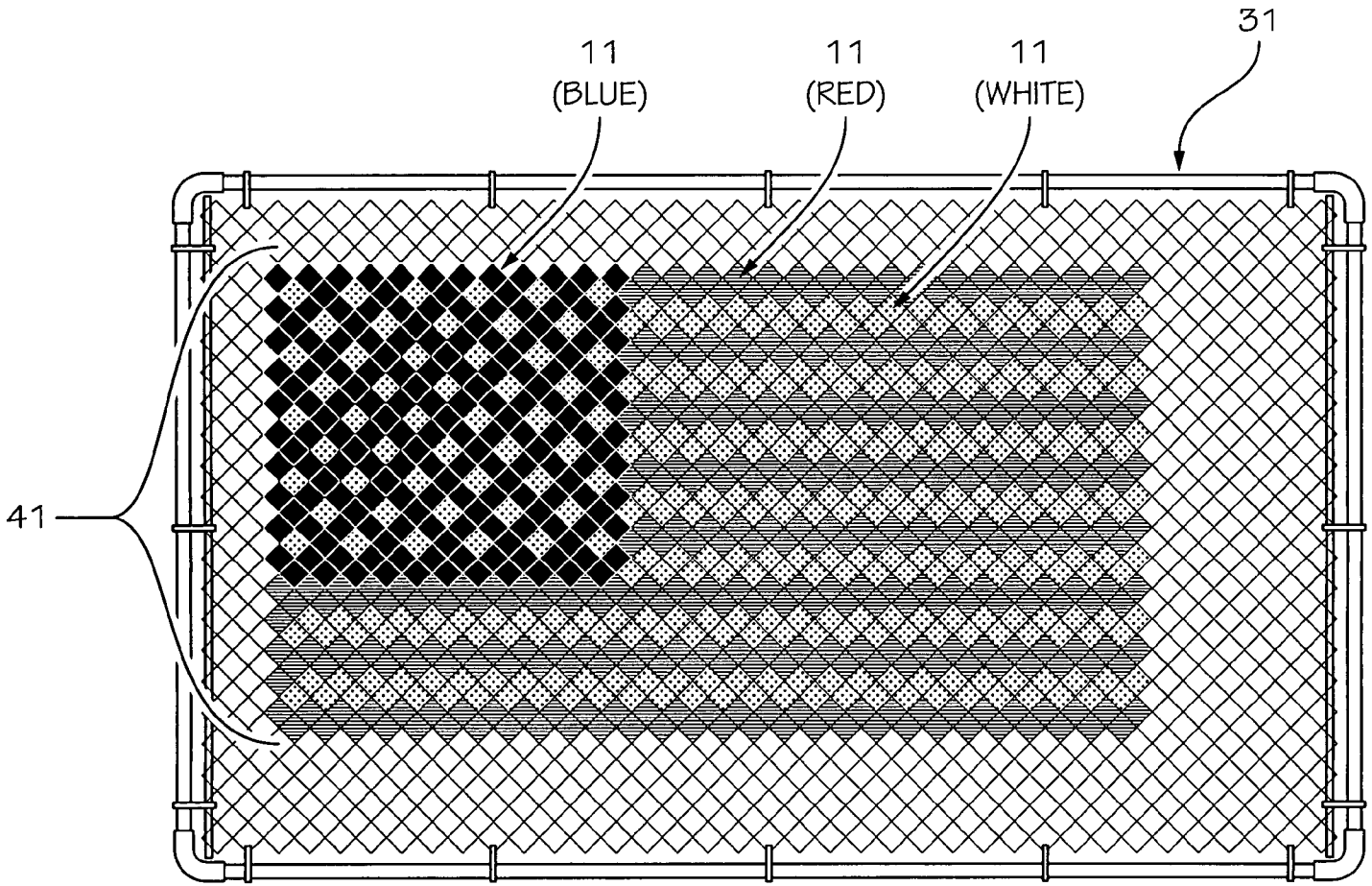
FIG. 9 depicts an alternative example of one implementation of the present invention to generate a flag design on a conventional chain-link fence.

Referring now to FIG. 9 in the drawings, apparatuses 11 may be sold or distributed in kits which can be used to create selected designs and messages. In the case of FIG. 9, a kit 41 consisting of a predetermined number of apparatuses 11 of particular colors, coatings, and treatments allows the user to create a design of an American flag on fence 31. It will be appreciated that an innumerable number of such individualized kits 41 may be provided. Kits 41 can be provided such that all of the apparatuses 11 in the kit are used, and none are left over to be stored.

In one embodiment of the present invention, a kit 41 may include a template that can be placed on the fence, either temporarily or permanently, that aids the user in quickly installing particular apparatuses 11 in particular holes in fence 31 to create the desired advertisement, message, pattern, or picture.

It should be understood that although apparatuses 11 have been shown dimensioned to be installed into a single hole of fence 31, apparatuses 11 may be dimensioned and configured with slots or gaps in side surfaces 15 such that apparatuses 11 span across several holes in fence 31. With this arrangement, fewer apparatuses 11 are required to make the same size display.

Figure 10A:
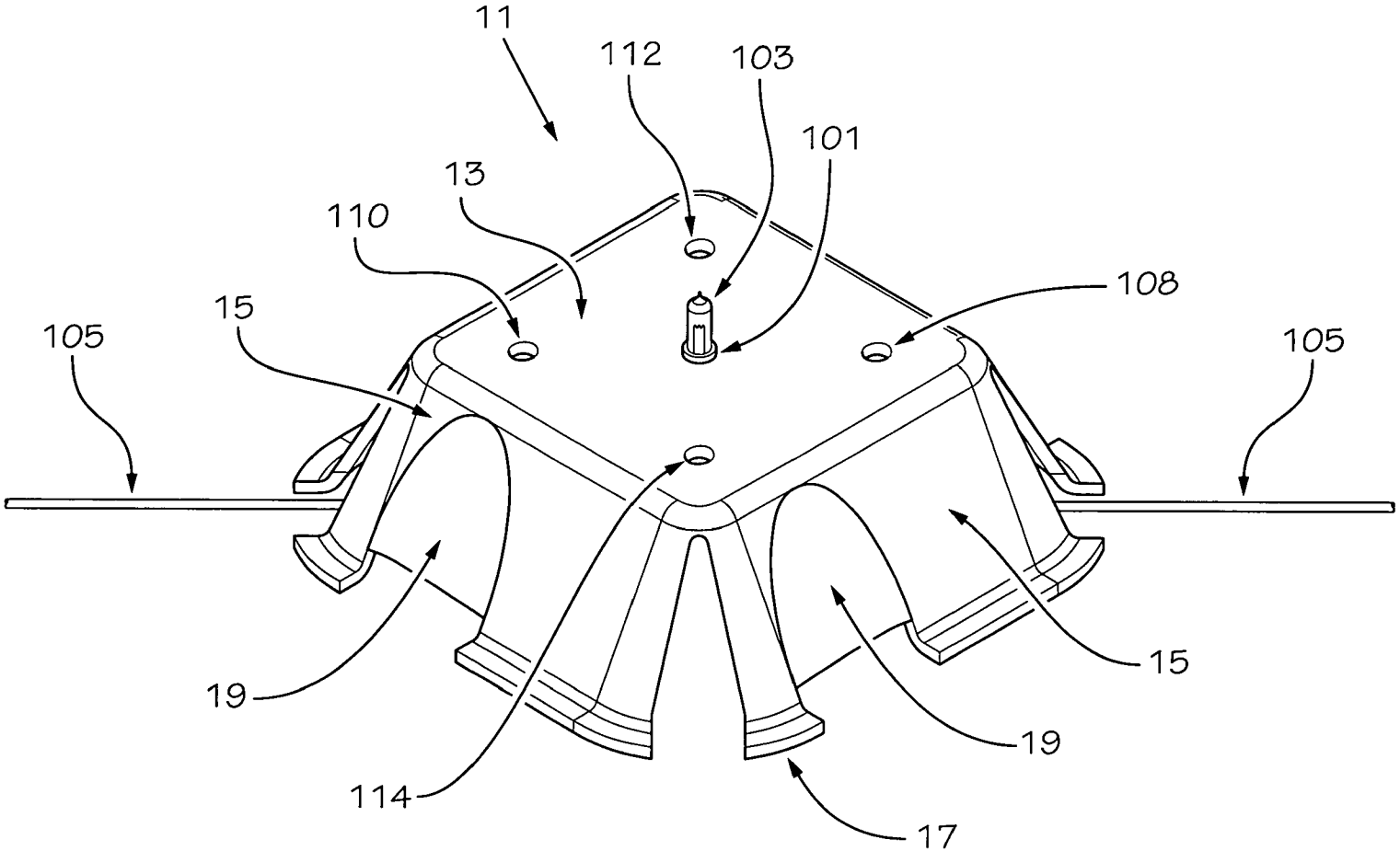
FIGS. 10A and 10B depict an alternative embodiment of the present invention with a lighting element carried by the insert.
Figure 10B:
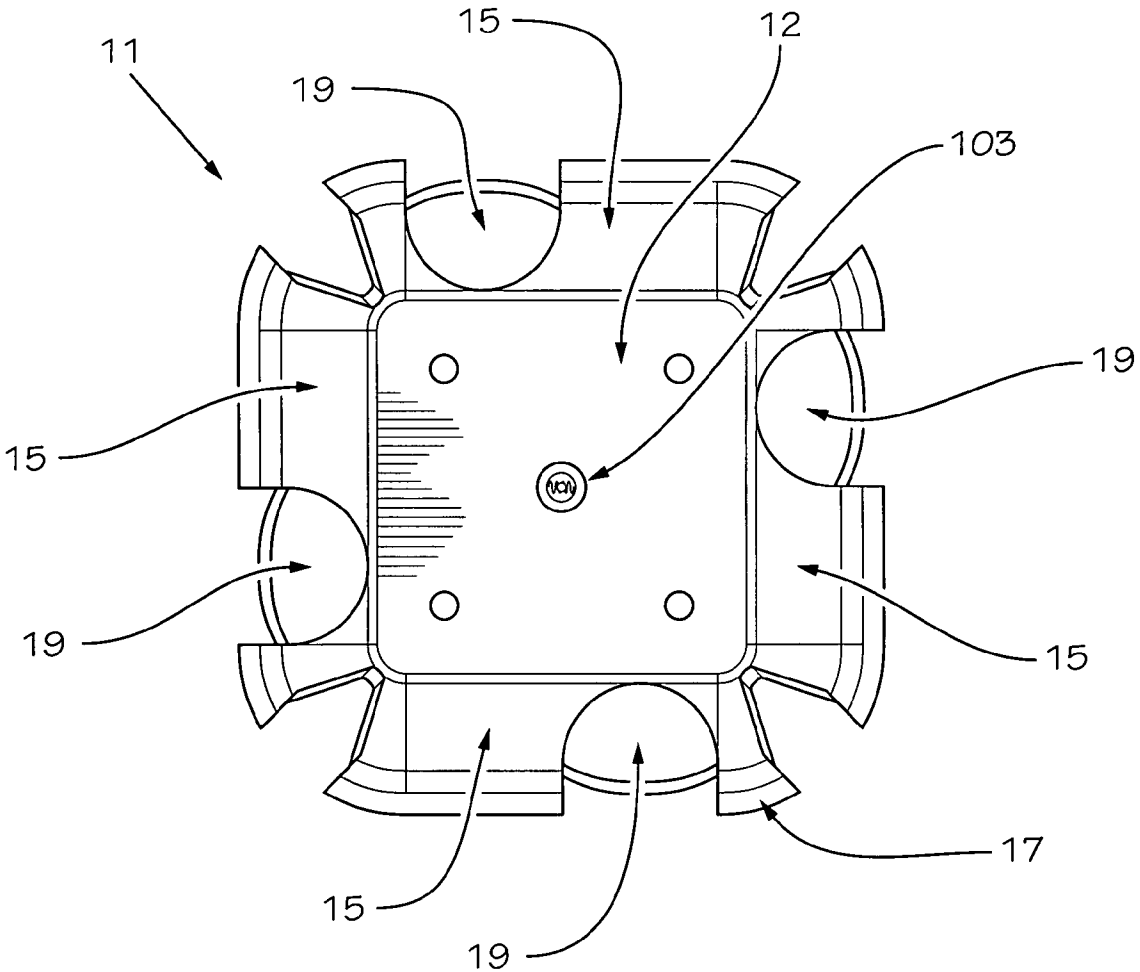

FIGS. 10 and 10B depict an alternative embodiment of apparatus 11. FIG. 10A depicts placement of a lighting element on one side of the insert while FIG. 10B depicts the placement of the lighting element on the other side. As is shown, an aperture 101 is provided in upper surface 13 of apparatus 11. The aperture is shaped in size in a manner which allows for a small light bulb 103 to be inserted therethrough. Light bulb 103 is electrically connected to power cord 105. Light bulb 103 may comprise one bulb on a string of lights such as Christmas lights. In this alternative embodiment, some or all of the apparatus 11 inserts may be provided with a lighting element. Interesting combinations of lighted and unlighted portions can be obtained for effective advertisement or dramatic displays. A plurality of punch-out (pre-cut circles) portions may be provided to allow the placement of more than one lighting element in a single insert. In the view of FIG. 20A, punch-out portions 108, 110, 112 and 114 are provided. This particular insert can accommodate up to five light elements.

Figure 11A:
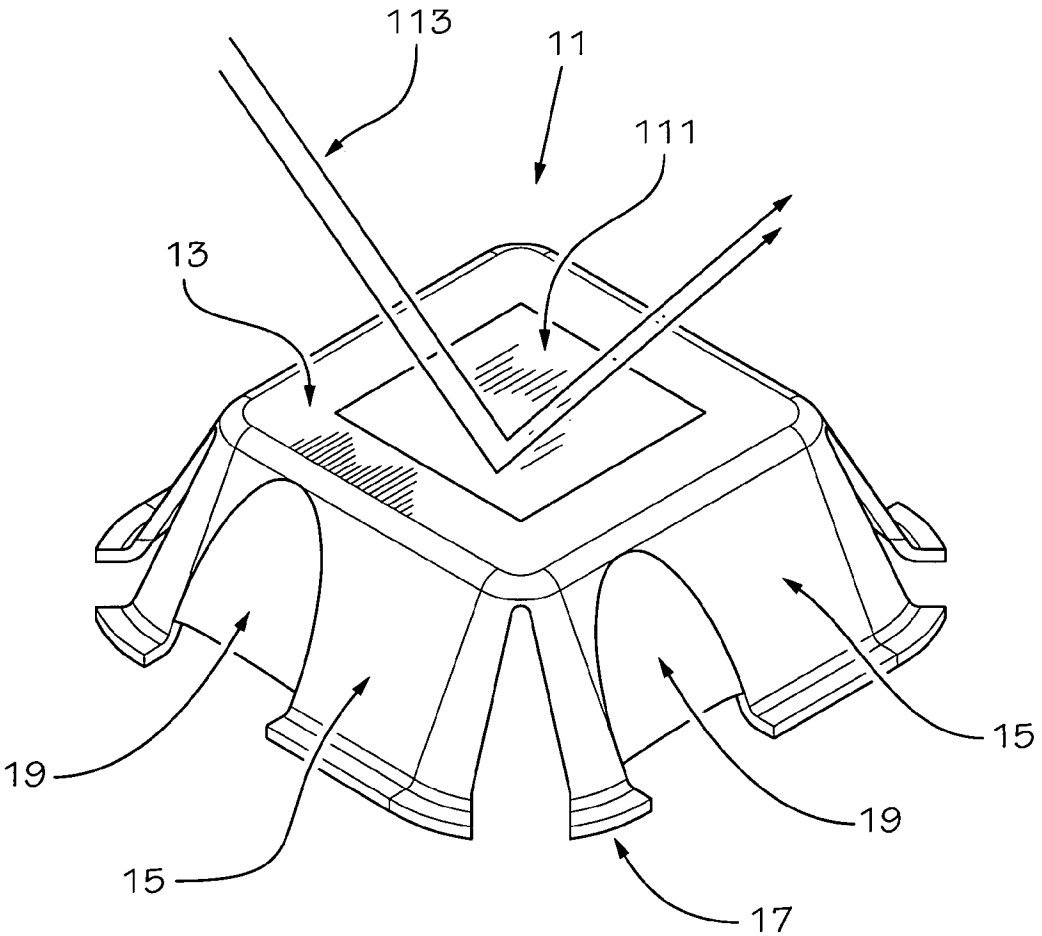
FIGS. 11A and 11B depict an alternative embodiment of the present invention with a reflective surface provided on the insert.
Figure 11B:
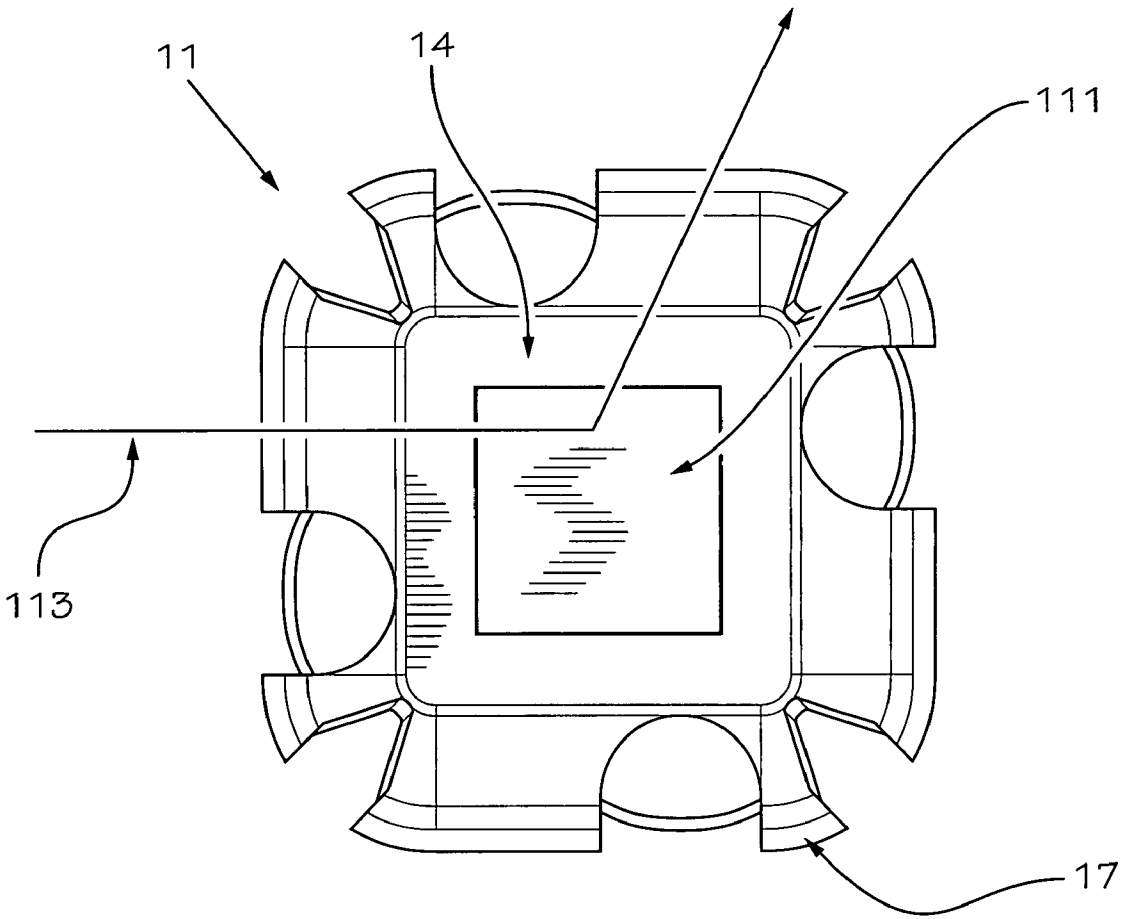

FIGS. 11A and 11B depict an alternative embodiment of the present invention in which the insert is provided with a reflective surface. FIG. 11A depicts the placement of the reflective surface on one side of the insert, while FIG. 11B depicts the placement of the reflective surface on the other side. The reflective surface may be applied to upper surface 13 or it may integrally formed into upper surface 13. As is shown in the view of FIG. 11, reflective material 111 will reflect light rays 113. Effective advertisement and interesting designs can be obtained by intermixing reflective apparatus 11 inserts with non-reflective apparatus inserts.

Figure 12:
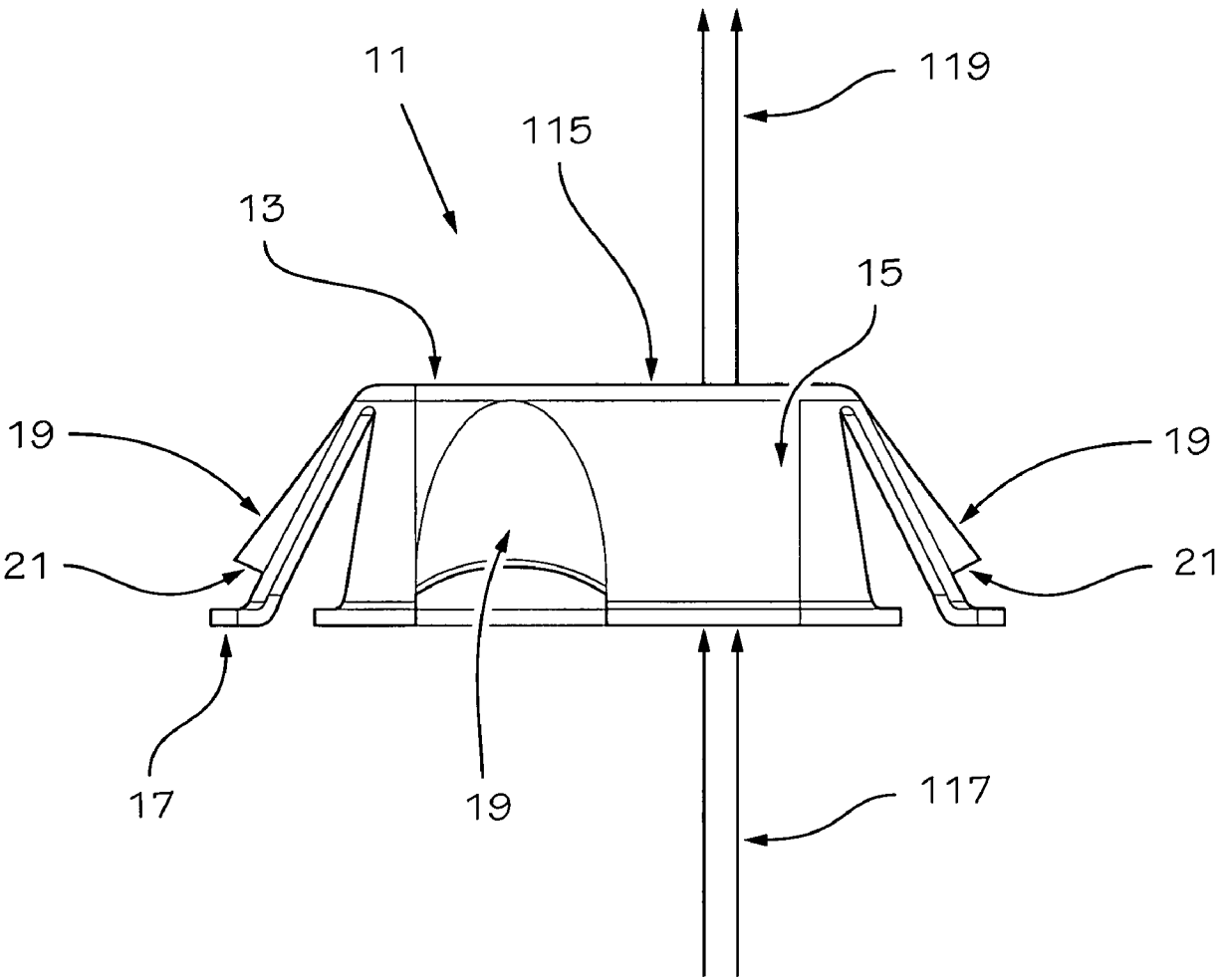
FIG. 12 depicts an alternative embodiment of the present invention which includes a portion which is translucent.

FIG. 12 depicts an alternative embodiment of the present invention in which upper surface 13 of apparatus 11 is formed of a translucent material which allows the passage of light therethrough. Upper surface 13 may be clear in order to allow a full spectrum of light to pass through it, or it may be colored in order to provide a stained-glass effect. It can be appreciated that effective advertisements and interesting designs may be obtained by utilizing different colored apparatus 11 inserts in order to form a stained-glass type display utilizing different colors. Additionally, translucent apparatus 11 inserts may be utilized in combination with non-translucent apparatus 11 inserts in order to obtain effective and interesting advertisements and displays.

Figure 13:
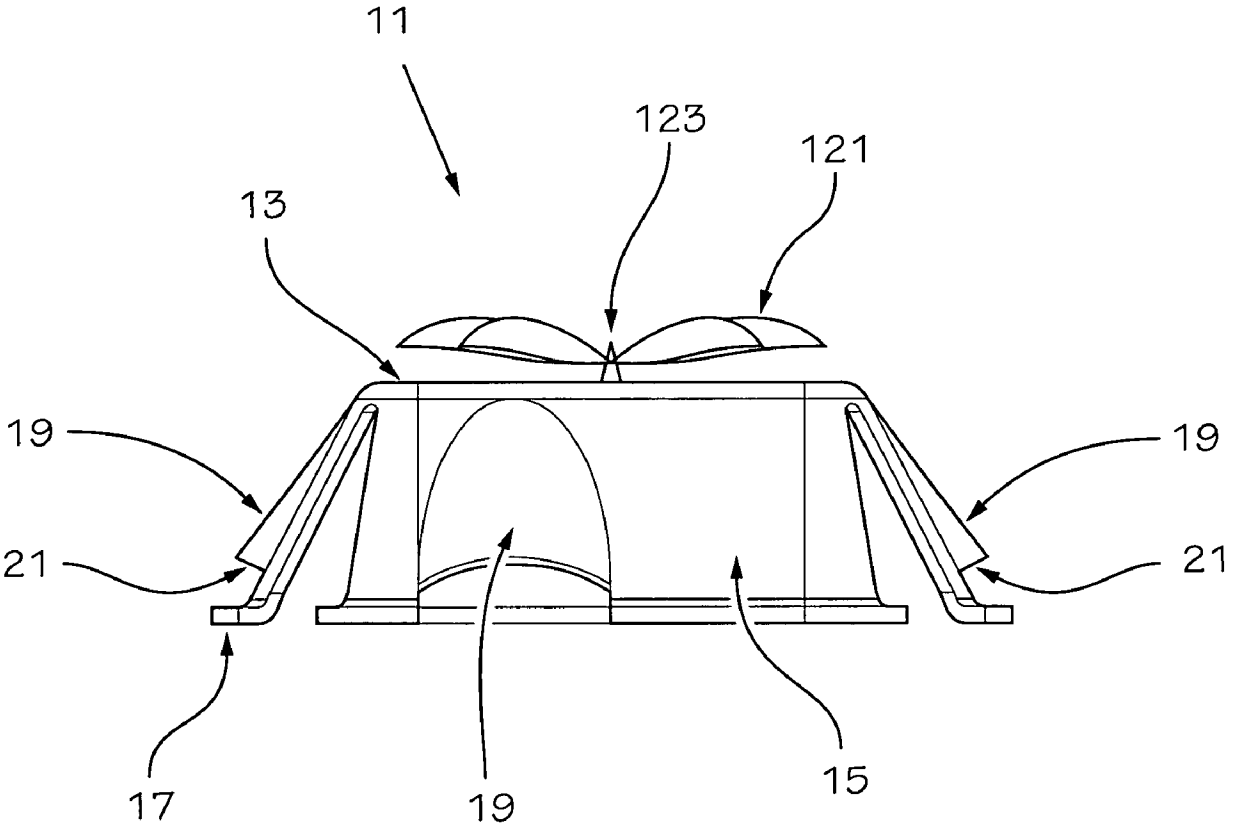
FIG. 13 depicts an alternative embodiment of the present invention which includes a moving component such as a "pin-wheel" element.

FIG. 13 depicts yet another alterative embodiment of the present invention in which apparatus 11 insert is provided with a moving component 121. The moving component 121 may comprise a pin-wheel type component which is moved by the passage of wind. In this particular embodiment, the moving component 121 is pinned to upper surface 13 by pin 123. In yet alternative embodiments, small electric motors can be provided which rotate moving component 121.

Figure 14:
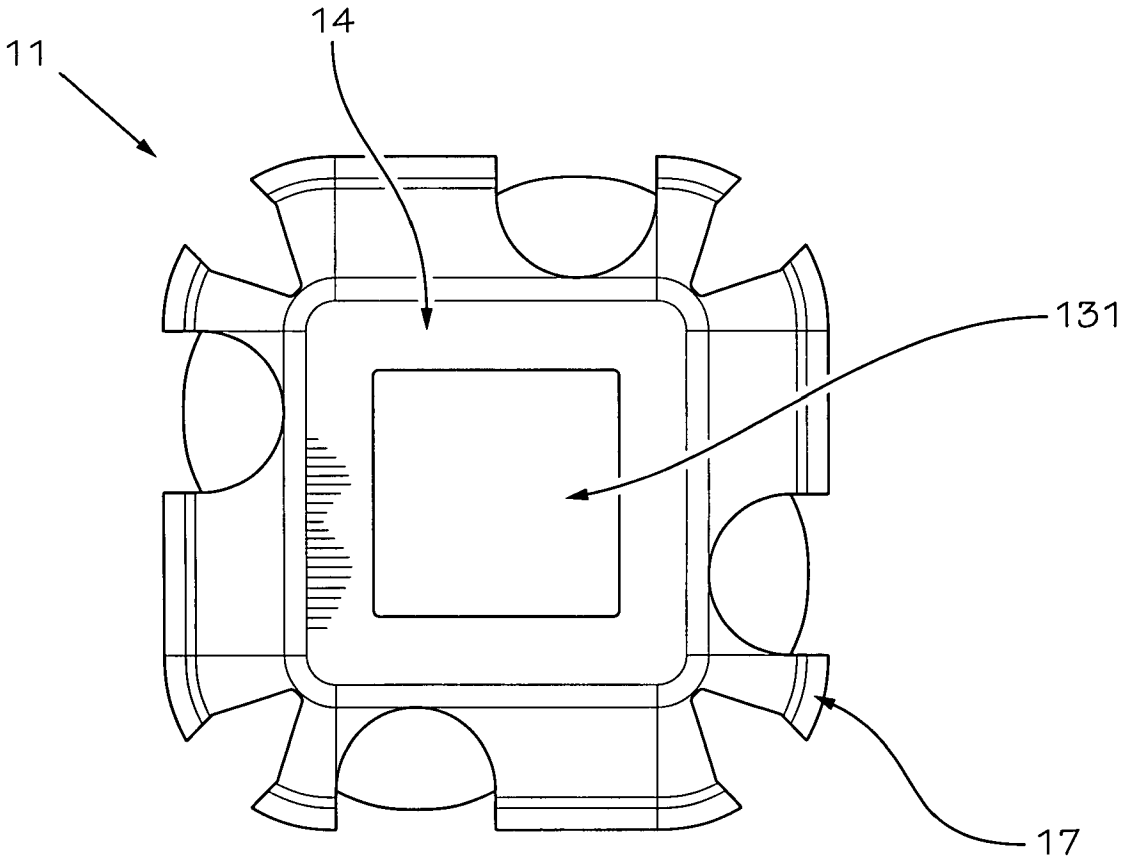
FIG. 14 depicts an alternative embodiment of the present invention with a cut-out portion.

FIG. 14 depicts yet another alternative embodiment of the present invention in which a apparatus 11 insert is provided with a cut-out portion 131 which allows a partial view through apparatus 11. It can be appreciated that effective advertisements and designs can be obtained by combining apparatus 11 inserts with cut-out portions 131 with other apparatus 11 inserts which do not contain cut-out portions.

Figure 15:
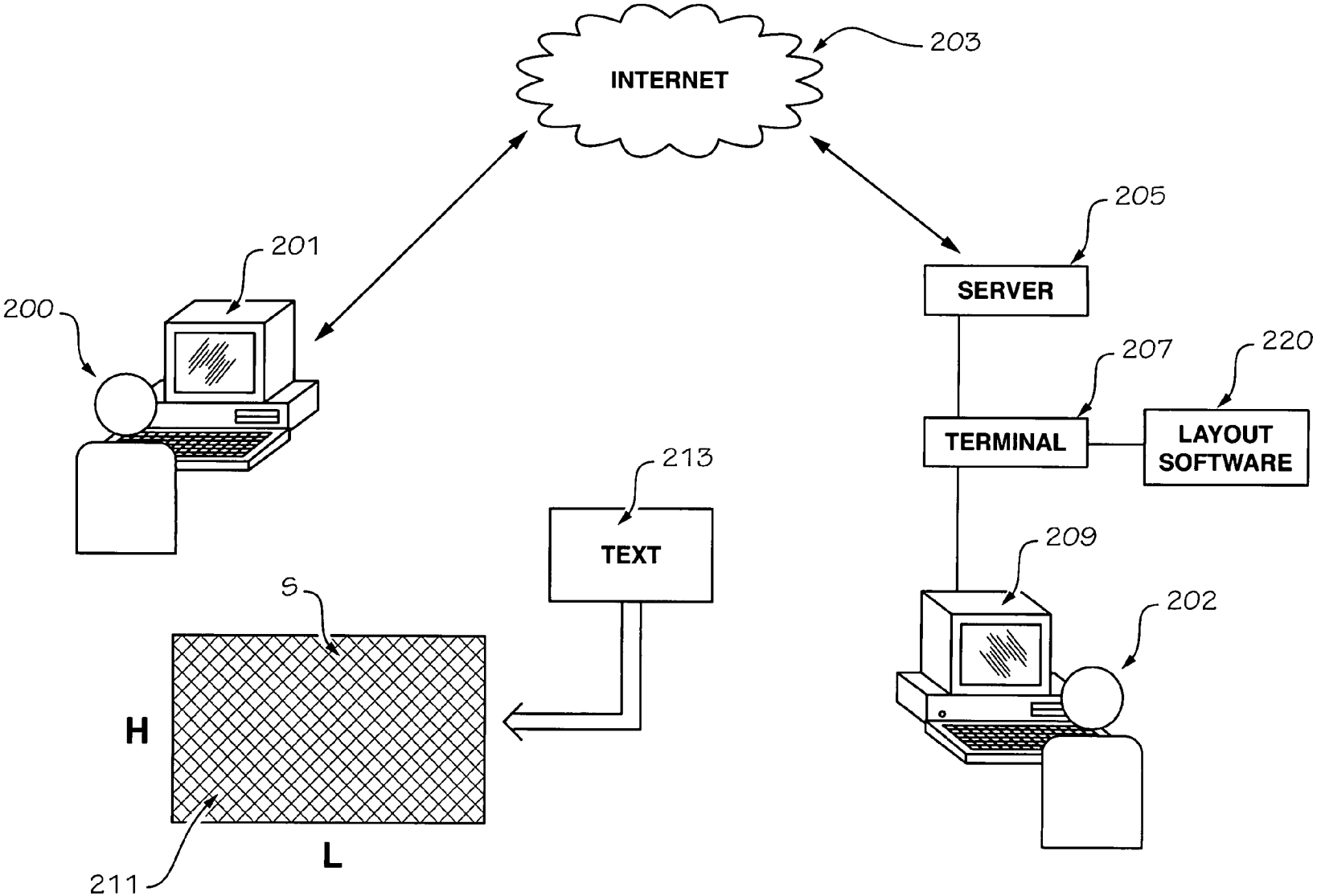
FIG. 15 is a block diagram view of an internet-moderated system for generating purchase orders and providing layout instructions and graphics.

The internet may be utilized in order to facilitate the utilization of the apparatus 11 inserts of the present invention. One scenario is depicted in FIG. 15. As is shown, a customer 200 utilizes a computer 201 to connect through internet 203 with a website which allows customers to purchase inserts for particular projects. The website is supported by server 205. One or more service terminals 207 may be provided which connect to computers such as computer 209 which is operated by a service representative 202. The purpose of the internet site is to allow customer 200 to place and order for the correct size inserts, of a correct number, in correct color and other design options considerations. FIG. 15 shows a simplified situation in which a customer 200 has a fence 211 which has a height H and length L, with chain-link mesh having a size S. Customer 200 desires to place a text message 213 on this fence. The customer has particular design consideration decisions to make and must select a size for the characters, and color for the text elements. Customer 200 may also want to provide background elements or borders around the text 213 which have different colors. Customer 200 will communicate the parameters through the internet 203 where a customer service representative 202 may assist in the purchase order. Alternatively, the website can be completely automated and utilize no human customer service representatives. The layout software 220 operates upon the parameters provided by customer 200 in order to generate a purchase order and a set of instructions which may include a graphic which "maps" the position of each insert in order to facilitate installation.

Figure 16:
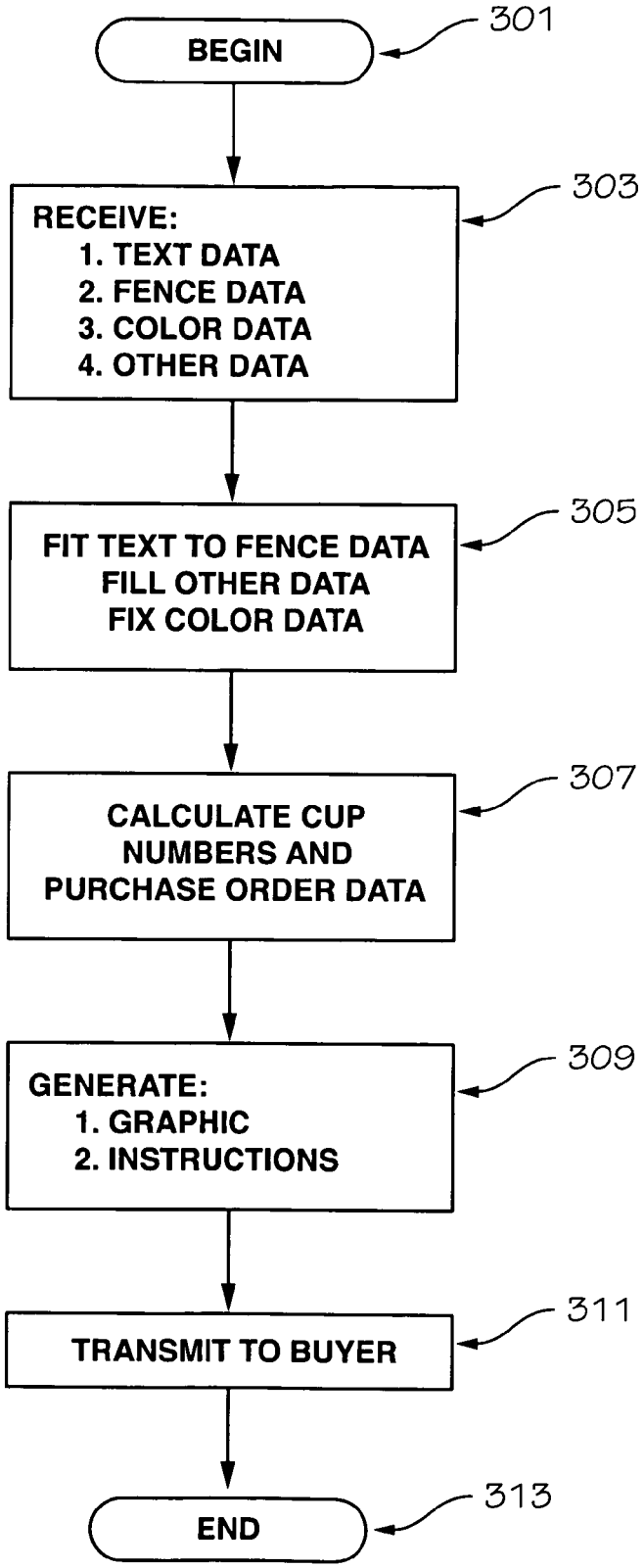
FIG. 16 is a simplified flowchart representation of the layout software of FIG. 15.

FIG. 16 is a simplified flowchart representation of this automated layout software 220. The process begins at block 301. It continues at software block 303, wherein the layout software 220 receives the text data, the fence data, the color data, and other data, preferably, an automated questionnaire is utilized to prompt the customer 200 to enter the data for processing. In accordance with software block 305, layout software 220 fits the text to the fence data. It will additionally fill in other data such as background and border requirements. Additionally, it will fix or determine the color data. Utilizing this information, layout software 220 will, in step 307, calculate the number of inserts required and port this information over to a purchase order screen which is displayed to the customer. The customer may be provided with an opportunity to correct the order if the cost is too high. Once the customer accepts the purchase order, layout software 220 will generate a graphic which is utilized by the customer 200 in order to layout the inserts. Nationally, it may generate written instructions which may be utilized in combination with the graphic in order to facilitate the layout of the inserts. The information is transmitted in step 311 to the customer 200 and the product is shipped to the customer by conventional means. The process ends at block 313.

Figure 17:
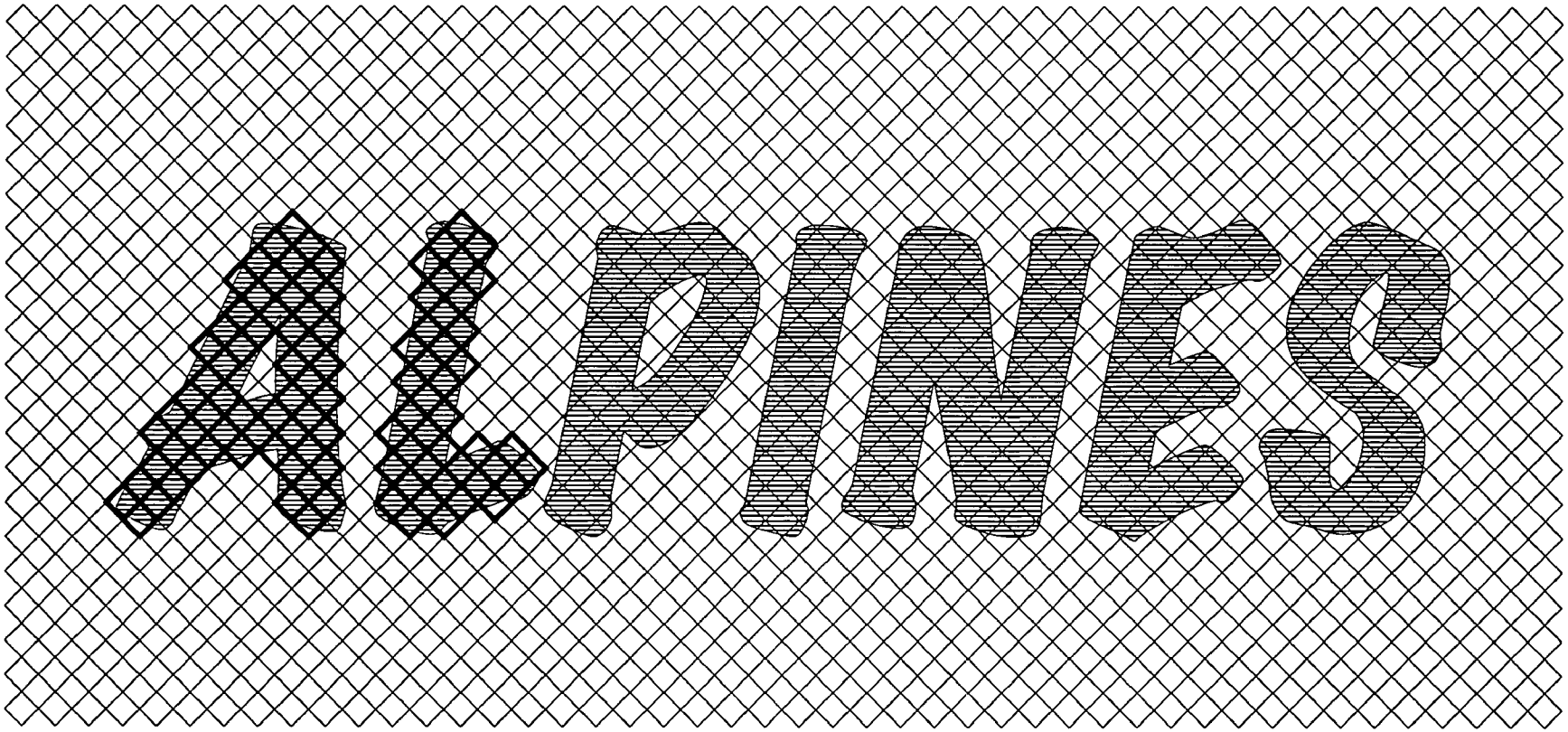
FIG. 17 is a exemplar graphic which may be generated utilizing the layout software of the present invention.

FIG. 17 depicts on example of a graphic which may be generated in accordance with the present invention. The graphic shows the relative position of each insert relative to the chain-link fence in order to accommodate the word "Alpines" on a particular sized chain-link fence.

Figure 18:
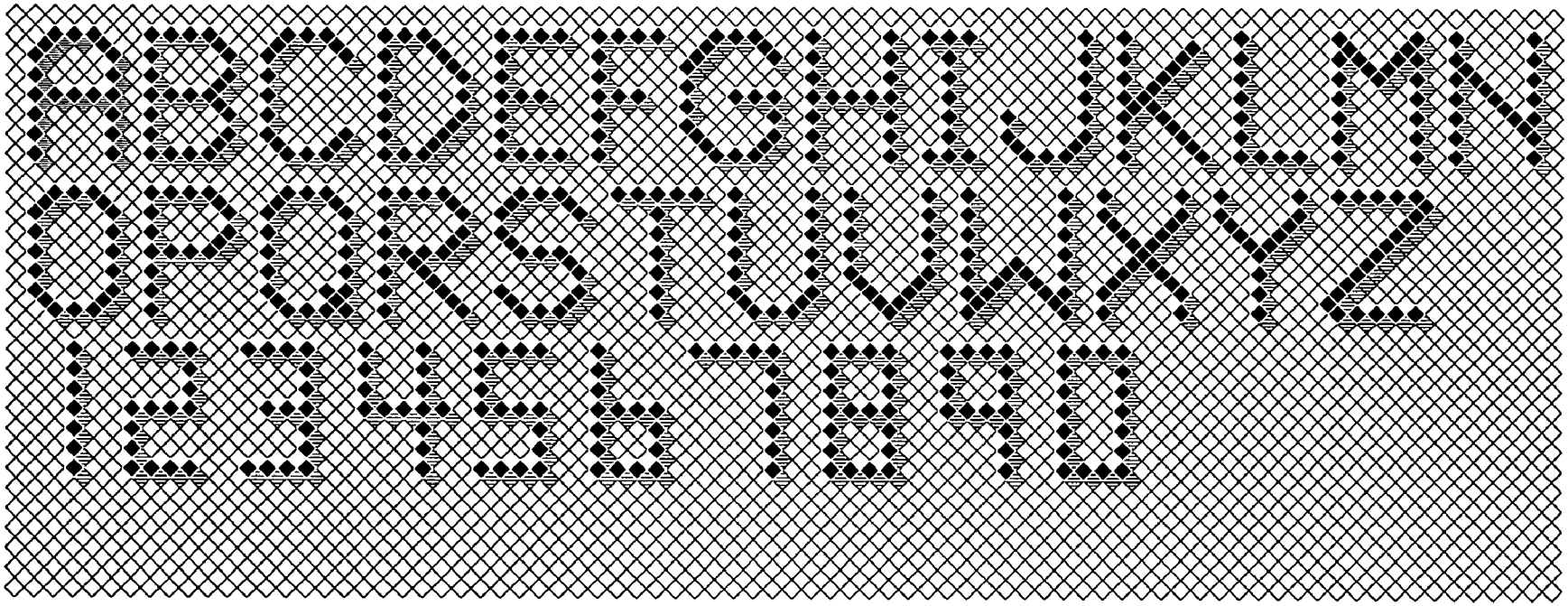
FIG. 18 depicts one schema for representing alphabetic and numeric characters.

FIG. 18 depicts one design of characters which represent alphabetic and numeric characters. These are designed with two different colored inserts in a manner which emphasizes the alphabetic and numeric characters. In the view of FIG. 18, a red and blue combination is utilized to generate alphabetic and numeric characters. Alternative designs may be generated for a different system of displaying alphabetic and numeric characters. For example, different color combinations can be utilized. As an alternative example, different shapes can be utilized for portions of the alphabetic and numeric characters.

Figure 19:
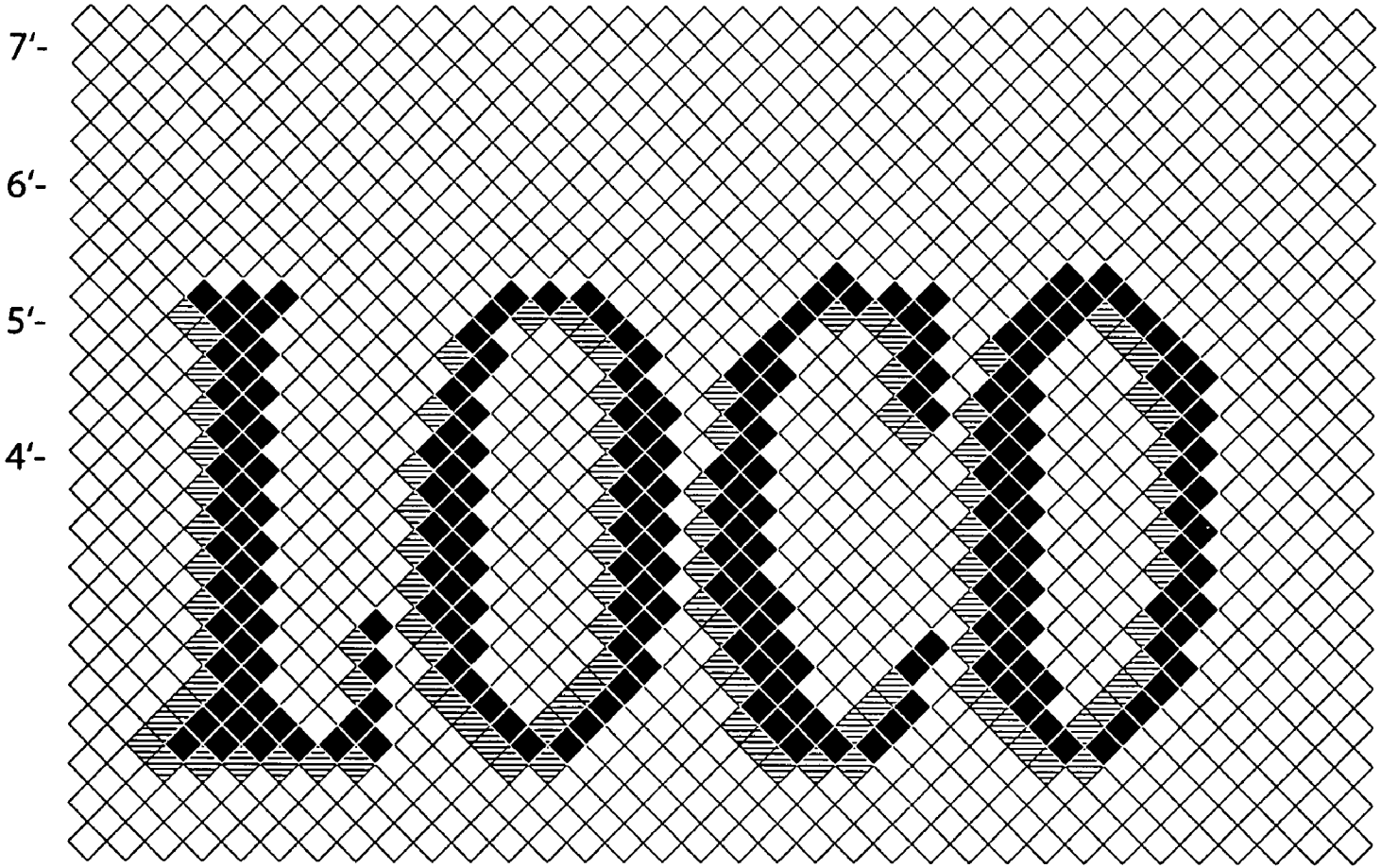
FIG. 19 depicts one alternative schema utilized to generate the word "LOCO" on a fence.

FIG. 19 depicts one exemplary situation in which the word "LOCO" is provided on a fence utilizing a particular different alphabetic characters. In the view of FIG. 19, blue and green color combination is utilized in each of the alphabetic characters. Additionally, the shapes of the characters differ from that of the alphabetic schema which is represented in FIG. 18.

Figure 20:
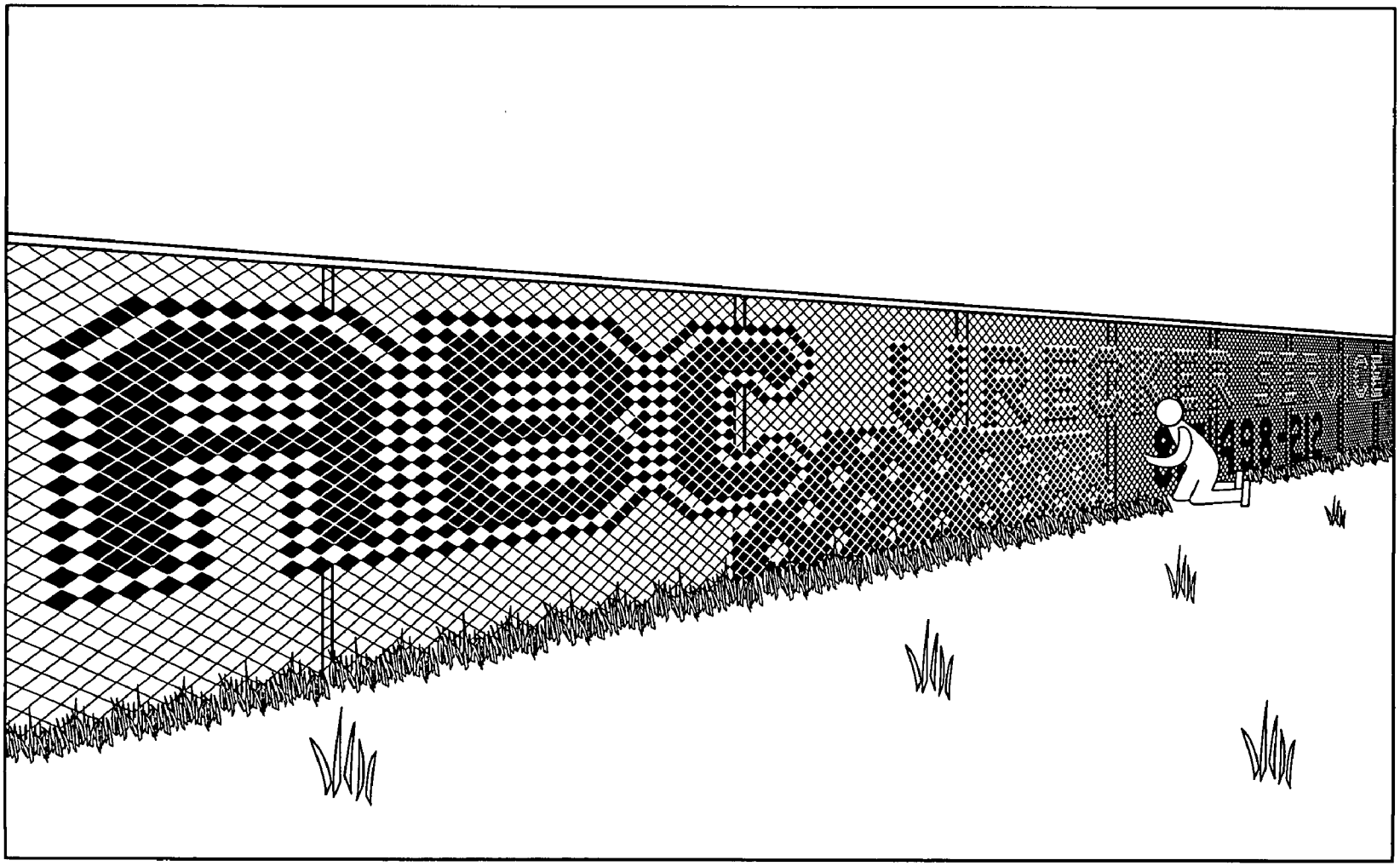
FIGS. 20 through 27 depict particular implementations of the present invention in order to generate text and design elements on chain-link fences.

A variety of interesting commercial applications may be achieved utilizing the present invention. FIGS. 20 through 27 depict a variety of displays which include text and graphical components. In the view of FIG. 20, the words "ABC WRECKER SERVICE" are provided utilizing a particular schema for representing alphabetic characters. The letters "ABC" are generated utilizing a combination of red, white and blue inserts. The words "WRECKER SERVICE" are generated utilizing a red and white combination of inserts. Below the text, a graphic component which is representative of an American flag is provided utilizing a combination of red, white and blue inserts. Notice that the telephone number for this business establishment is provided in mainly black colored numeric characters which are worked into the stripes portion of the flag design. This effect makes the telephone number appear to be intermixed with the striped portions of the flag design.

Figure 21:
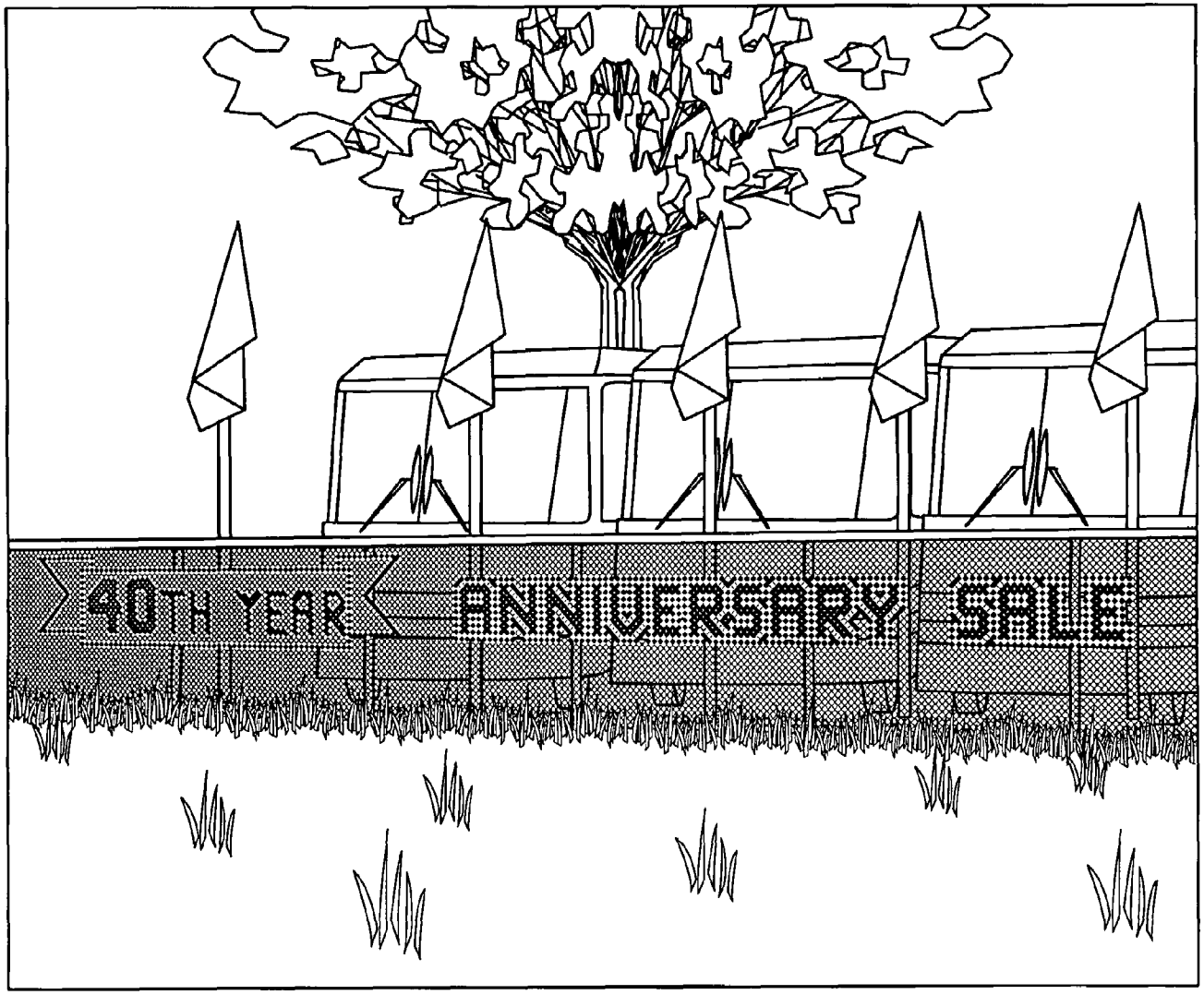

FIG. 21 depicts an alternative implementation. In this view, the words "ANNIVERSARY SALE" are provided utilizing a combination of white, yellow and red inserts, in accordance with the particular schema for representing alphabetic characters. Adjacent to this text is a yellow banner design which is formed through a combination of yellow and black inserts. The text "$40^{TH}$ YEAR" is provided in the center portion of the banner utilizing a combination of red and white inserts. The banner is colored yellow by utilizing yellow inserts. The peripheral portion of the banner is set forth utilizing black inserts.

Figure 22:
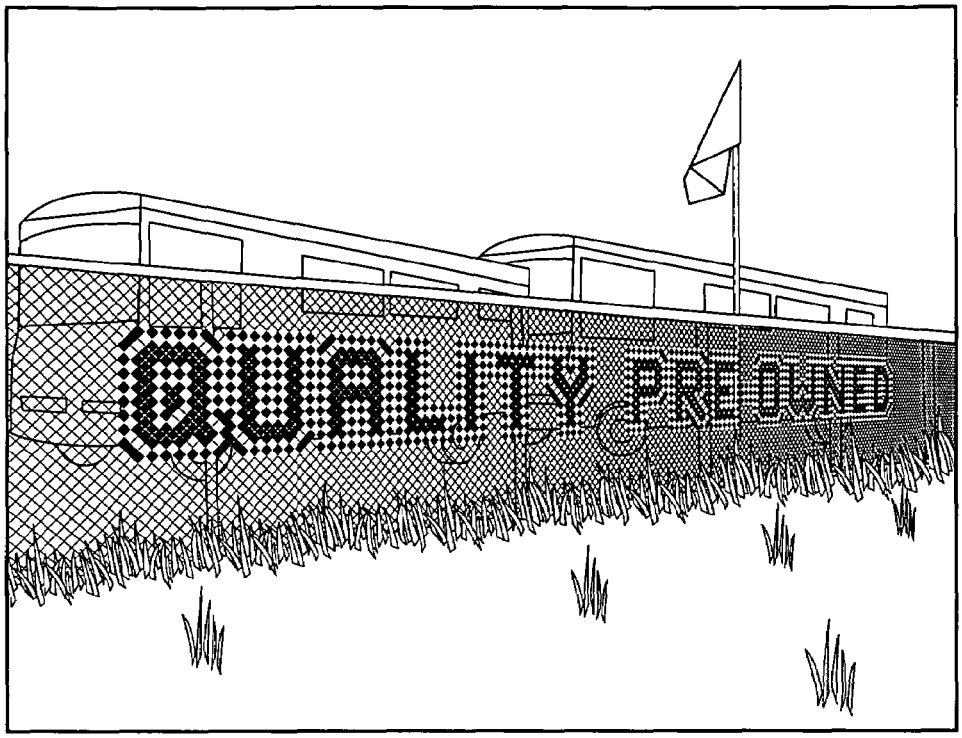

FIG. 22 depicts an alternative implementation of the present invention. As is shown, the letters "QUALITY PREOWNED" are provided utilizing a combination of red, white and blue inserts, utilizing a particular schema of representing alphabetic characters.

Figure 23:
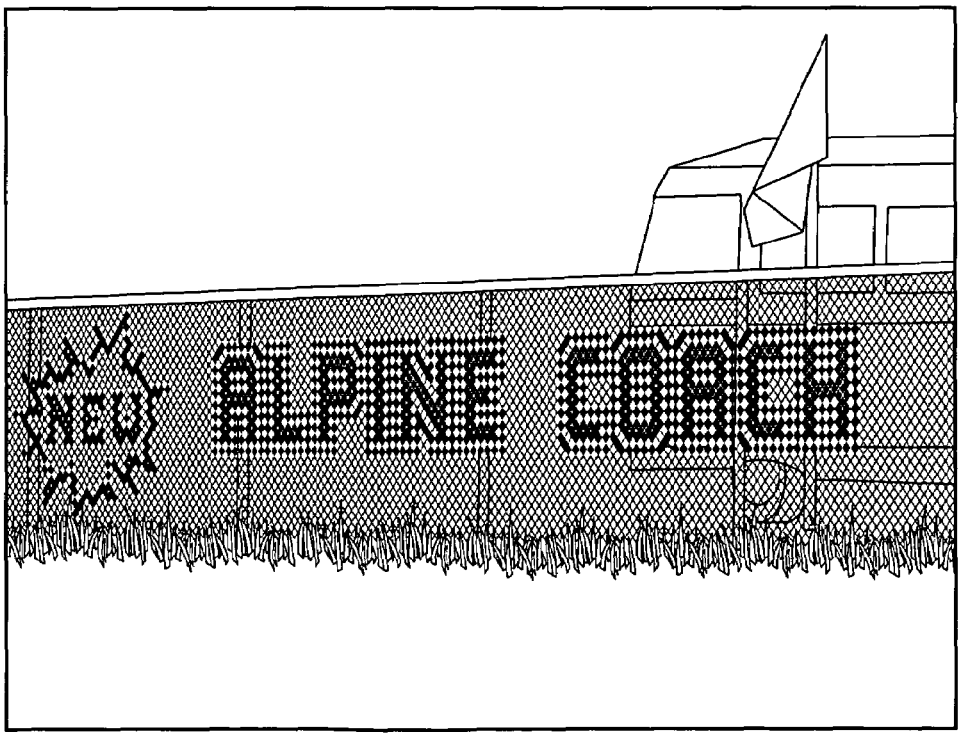

FIG. 23 depicts an alternative implementation in which the words "ALPINE COACH" are provided utilizing a combination of red, blue, and white inserts. Adjacent this text is a design which is representative of a "splash" which is formed from white inserts surrounded largely by blue inserts. In the center of the "splash" the word "NEW" is provided utilizing red inserts.

Figure 24:
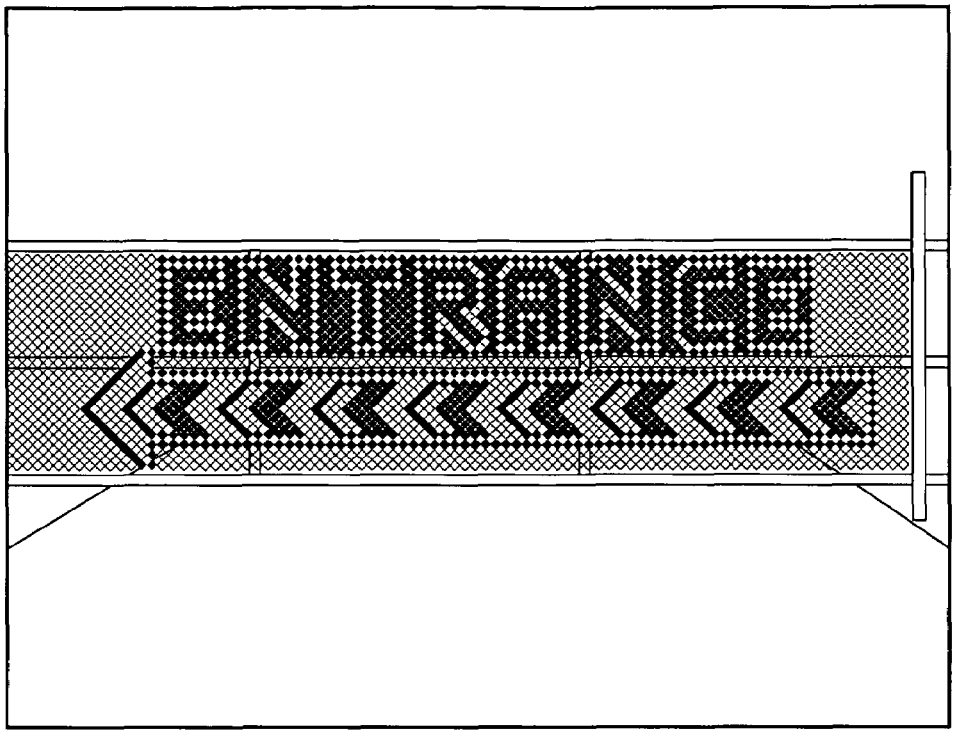

An alternative example is provided in FIG. 24. In this example, the word "ENTRANCE" is provided utilizing white and red inserts in accordance with a particular alphabetic schema. The word "ENTRACE" is provided on a blue background which is rectangular in shape. Beneath the word "ENTRANCE" is a design component which is an arrow pointing to the entrance to the business establishment. The arrow is formed utilizing red, white and blue inserts. A graphical element is provided in the center portion of the arrow which enhance the visual impact of the arrow.

Figure 25:
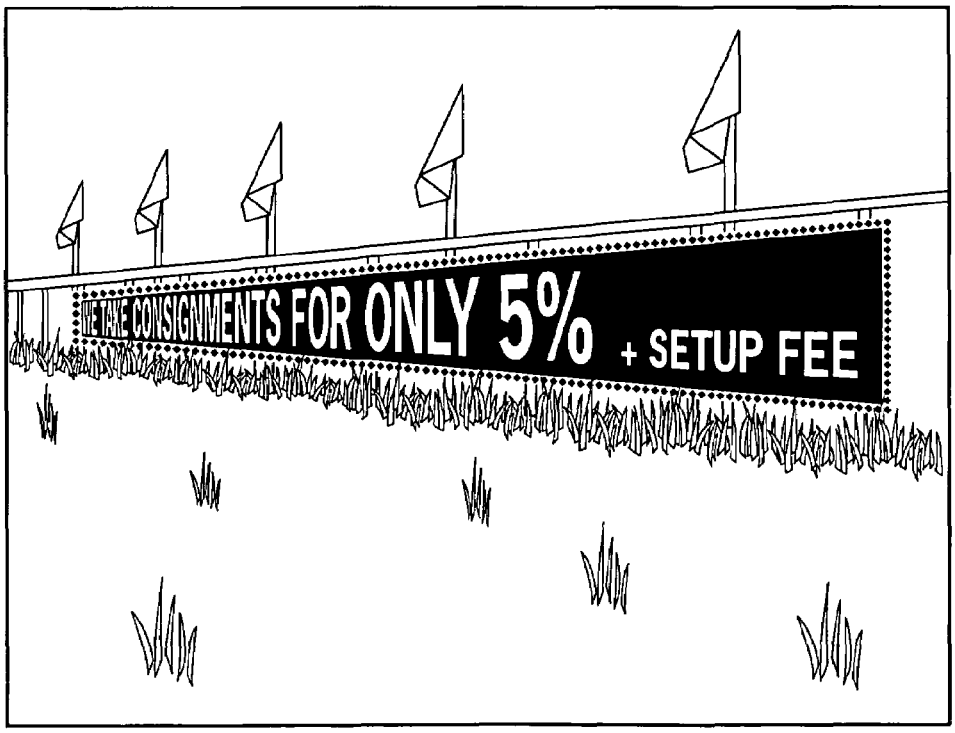

FIG. 25 depicts yet another alternative embodiment of the present invention in which inserts are utilized in combination with a banner ad which reads "WE TAKE CONSIGNMENTS FOR ONLY 5%+SETUP FEE." The banner ad is outlined by a border which is made up of red, white and blue inserts.

Figure 26:
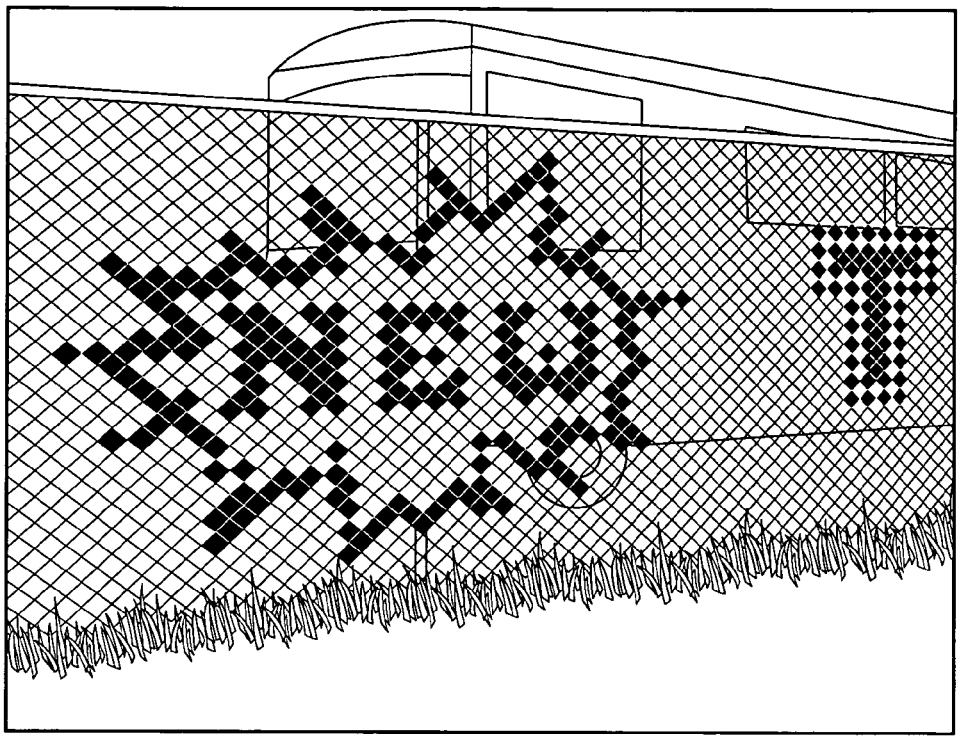
Figure 27:
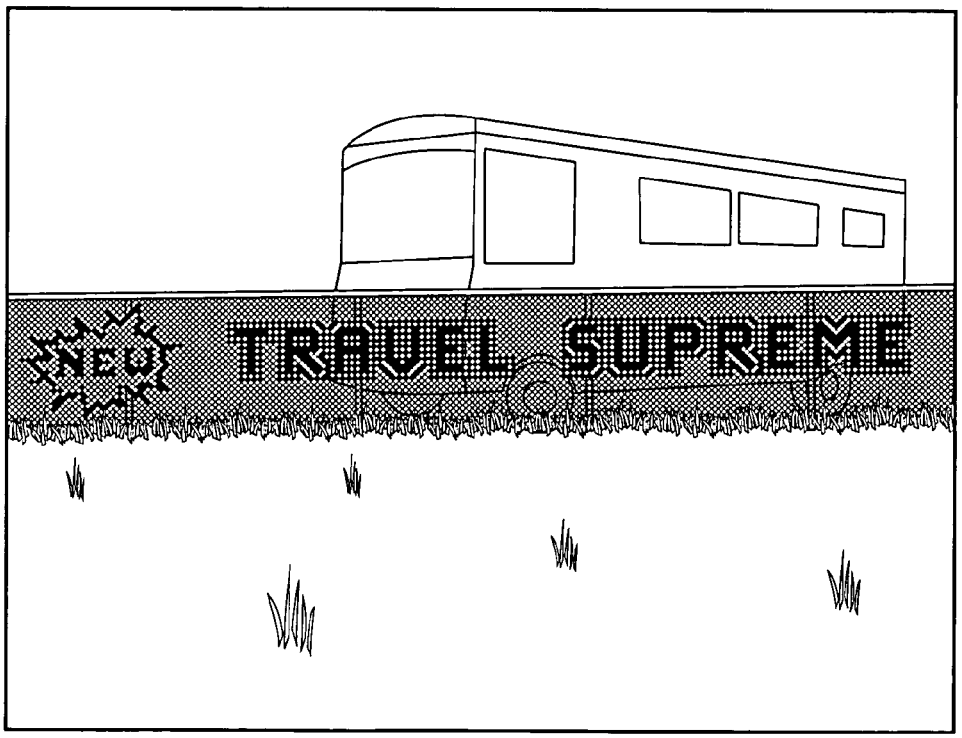

FIGS. 26 and 27 depict an alternative implementation of the present invention which generates the text "NEW TRAVEL SUPREME," with the word "NEW" centered on a "splash" design component. The text which forms the words "TRAVEL SUPREME" is formed utilizing red, white and blue inserts, in accordance with the particular alphabetic schema. The text which forms the word "NEW" is formed utilizing only red inserts. The splash design provides a white background. Blue inserts are utilized to emphasize the outer peripheral portion of the splash design component.

Figure 28A:
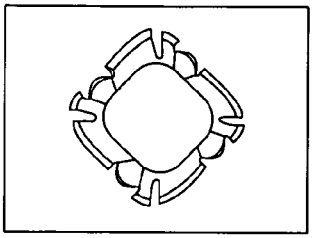
FIGS. 28A through 28F depict the method of installing the inserts of the present invention.
Figure 28B:
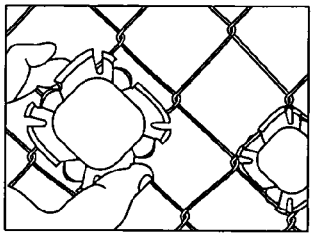
Figure 28C:
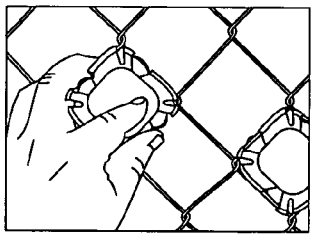
Figure 28D:
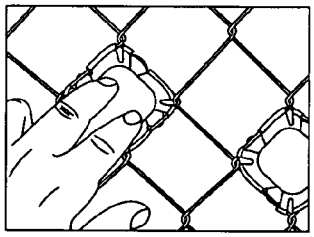
Figure 28E:
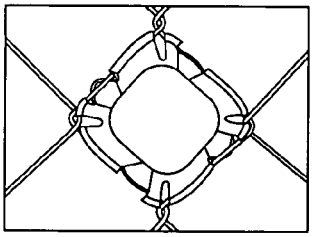
Figure 28F:
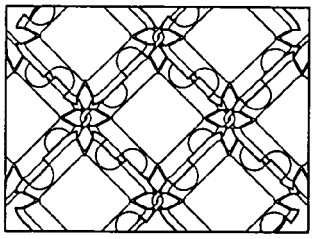

FIGS. 28A through 28F illustrate how the inserts of the present invention are placed into position. FIG. 28A depicts an insert prior to installation. FIG. 28B depicts the first step. In this first step, the installer grips the cup between his or her thumb and middle finger. As is depicted in FIG. 28C, in step number two, the installer squeezes the cup together and inserts the cup into the portion of the fence between wire mesh components. Then, as is depicted in FIG. 28D, in accordance with step three, the installer presses the middle of the cup to snap it into place. Snapping is accomplished when the latch portions of the insert are urged around the wire mesh components. The latch components will secure the insert by gripping the wire mesh component on one side, while the lip portion of the insert grips the other side of the wire mesh component. As is depicted in FIG. 28E, in accordance with step four, the installer then makes sure that the top-left and bottom-right tabs are securely fastened to the fence. FIG. 28F depicts a wire mesh fence with a section of white inserts.

Figure 29:
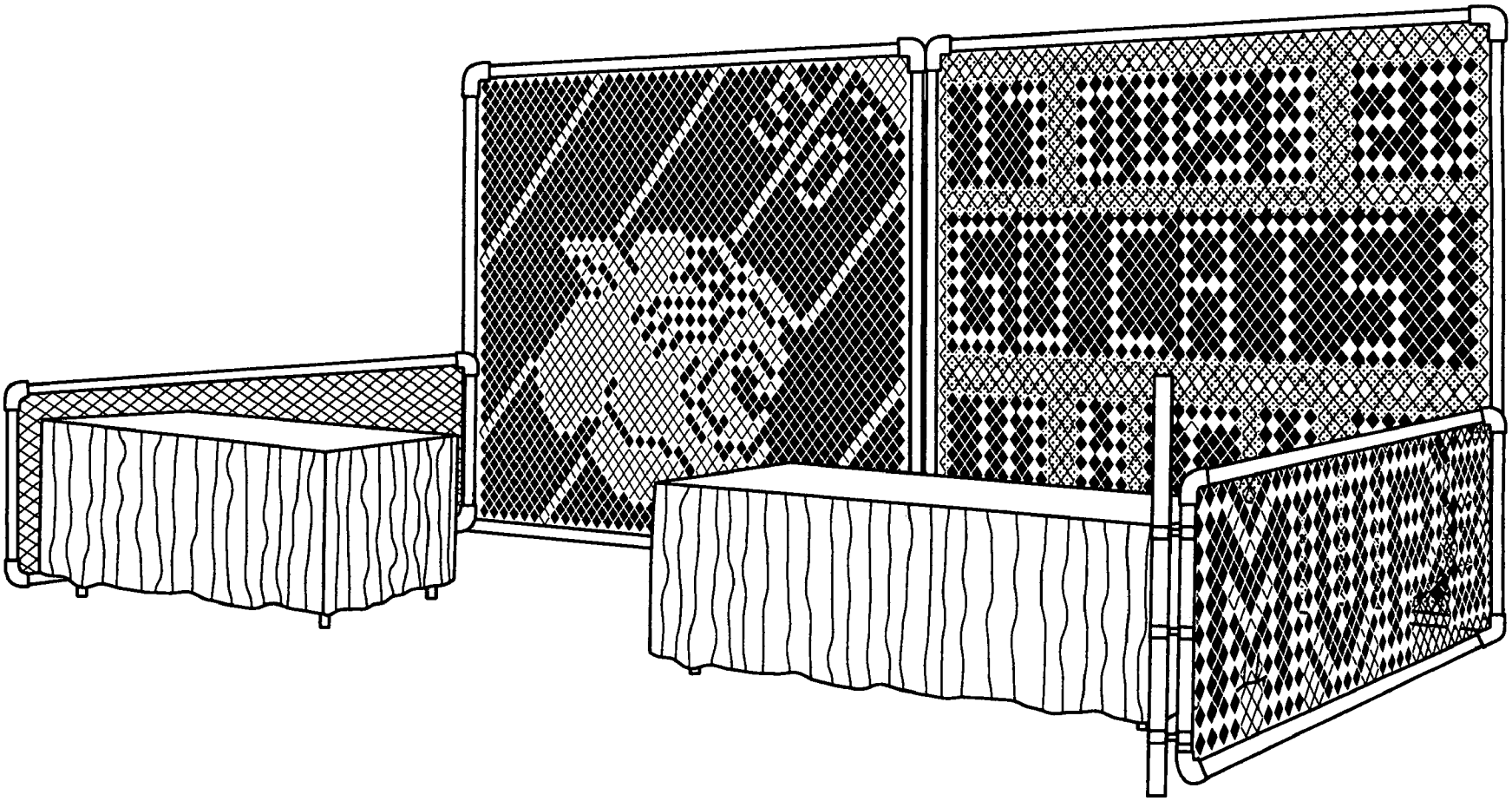
FIG. 29 depicts an implementation of the present invention which utilizes lighting elements carried by the inserts in order to provide a scoreboard for use in athletic events.
Figure 30E:
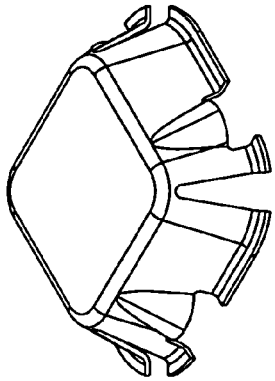
FIGS. 30A through 30F are manufacturing drawings for one embodiment of the present invention.
Figure 30F:
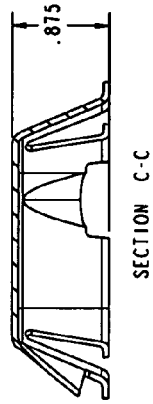
Figure 30C:
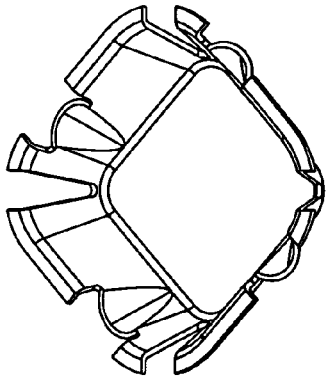
Figure 30D:
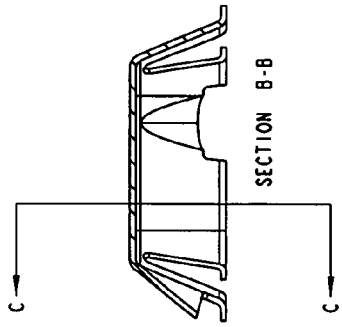
Figure 30A:
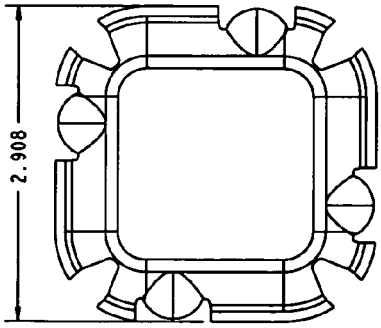
Figure 30B:
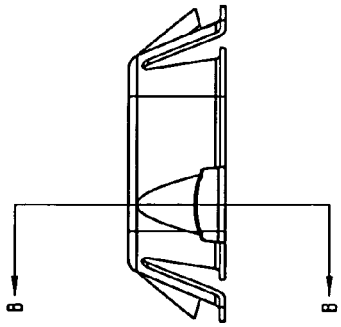

FIG. 29 depicts one implementation of the present invention which carries light elements in a manner which allows a chain-link fence to be turned into a scoreboard for use in sporting events. As is depicted, the score for the home and visiting teams is provided (17 versus 20) at the upper corners of the scoreboard. A clock is provided in the center portion. The text "GO CATS" is provided utilizing lighted inserts. In this implementation, the present invention may be utilized to provide an inexpensive scoreboard. The portions of the scoreboard which represent the scores of the home and vesting teams is laid out like a seven-segment display in order to represent the characters 0 through 9. The same is true for the clock component. A computer may be utilized to selectively energize the bulbs in order to actuate particular portions of the seven-segment display for each numerical character in the score and clock portions of this scoreboard.

The present invention may be utilized to increase privacy of a chain-link fence. This is accomplished by completely filling the openings of a chain-link fence with inserts which block the view through the chain-link fence. This is a relatively inexpensive way to turn a chain-link fence into a "privacy" fence. Additionally, the present invention can be utilized to reduce noise transmission in the region of a chain-link fence. This is accomplished by filling all or most of the openings of a chain-link fence with inserts. This will dampen the transmission of noise. It is especially useful in chain-link fences which surround noisy equipment such as oil and gas pumps.

Alternatively, the present invention can be utilized to increase the security of a chain-link fence. This is accomplished by filling all or most of the openings of a chain-link fence with inserts which deprive one of a foothold which can be utilized to climb a chain-link fence. Merely having the inserts in place may deter one from even trying to climb a chain-link fence.

In the present application, the present invention is depicted in use with the most common type of chain-link fence, which has generally square openings which are formed by strands of wire. The present invention may be utilized in any type of fence which is formed, at least in-part by wire strands. This includes fences which have openings which have a shape different than a square opening. For example, the present invention could be utilized in diamond-shaped openings. Alternatively, the present invention could be utilized in rectangular-shaped openings. Alternatively, the present invention could be used in octagonal-shaped openings. The present invention could be modified slightly to accommodate any of these shapes. The flat part of the insert would be sized in order to substantially fill the opening. The lip member and latch would be utilized to secure to at least one wire strand in order to hold the insert in place. These modifications could be easily obtained in order to have inserts which fit all types of openings in any type of fence which is formed in-part by a wire strand.

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the scope of the invention.

What is claimed is:

1. In combination, a chain-link fence having generally square openings and a device for insertion in said generally square openings, comprising:

a generally square, planar base having four edges;

four sidewalls each connected to a base edge at a first edge, and each having a distal edge opposite the first edge, wherein an angle between the base and each of the sidewalls is greater than 90 degrees, whereby the base and sidewalls have a shape generally that of a truncated pyramid;

wherein the base has a size less than the size of the fence openings, and wherein the distal edges of the sidewalls define a square having a size greater than the fence openings; and a lip connected to each sidewall distal edge and approximately parallel to the bae, wherein each lip extends away from the base.

2. The device according to claim 1 wherein said base, said sidewalls and, said lip are integrally formed.

3. The device of claim 1 further comprising:

at least one hole in the base adapted in size and shape to receive an electrically-powered light bulb.

4. The device of claim 1, further comprising:

a light reflective surface disposed on at least one surface of the base.

5. The device of claim 1, further comprising:

a slot between each pair of adjacent sidewalls.

6. The device of claim 5, wherein the sidewalls are flexible, wherein the sidewalls apply a bias against the chain-link fence when the device is inserted into a fence opening.

7. The device of claim 1, wherein each lip extends for only a portion of each sidewall distal edge, defining a non-lip portion of each distal edge, and further comprising:

a protrusion on each sidewall non-lip portion, wherein the protrusion projects in a direction away from and approximately parallel to the base, and wherein the protrusions lie in a plane closer to the base than the lips.

8. The device of claim 7, wherein the protrusions are closer to the base than the lips by a distance that is at least as great as a diameter of a chain-link of the fence.

9. The device of claim 7, wherein the protrusions project from the sidewalls for a distance approximately equal to a distance that the lips project form the sidewall distal edges.

10. The device of claim 7, wherein the protrusions form an arc of a circle.

11. The device of claim 10, wherein each sidewall forms a linearly increasing circular arc between the base and each protrusion to define a conic section.

12. The device of claim 7, wherein each protrusion is offset from a center portion of the sidewall so that it lies across from the lip of an opposing sidewall.

13. The device according to claim 7 wherein, during insertion, said chain-link fence engages said protrusions in an interference fit until said chain-link fence clears said base and snaps into a secure position.

14. A device for insertion in generally square openings of a chain-link fence, comprising:

a generally square, planar base having four edges;

first and second sidewalls each connected to a base edge at a first edge, and each having a distal edge opposite the first edge, wherein an angle between the base and each of the first and second sidewalls is greater than 90 degrees, wherein the first and second sidewalls are connected to opposite edges of the base;

third and fourth sidewalls each connected to a base edge at a first edge, and each having a distal edge opposite the first edge, wherein an angle between the base and each of the third and fourth sidewalls is greater than 90 degrees, wherein the third and fourth sidewalls are connected to opposite edges of the base;

wherein the base has a size less than the size of the fence openings, and wherein the distal edges of the sidewalls are at least as far apart as opposite sides of the chain-link fence openings;

first and second latch protrusions on the first and second sidewalls, respectively, the first and second latch protrusions extending from the sidewalls in a plane approximately parallel to the base, and in a direction away from the base, wherein the first and second latch protrusions are closer to the base than the first and second sidewall distal edges, respectively, and are offset in opposite directions from a center of their respective sidewalls; and first and second lips connected to the first and second sidewall distal edges, respectively, such lips extending from the sidewalls in a plane approximately parallel to the base, and in a direction away from the base.

15. The device of claim 14, further comprising:

third and fourth latch protrusions on the third and fourth sidewalls, respectively, the third and fourth latch protrusions extending from the sidewalls in a plane approximately parallel to the base, and in a direction away from the base, wherein the third and fourth latch protrusions are closer to the base than the third and fourth sidewall distal edges, respectively, and are offset in opposite directions from a center of their respective sidewalls; and third and fourth lips connected to the third and fourth sidewall distal edges, respectively, such lips extending from the sidewalls in a plane approximately parallel to the base, and in a direction away from the base.

16. The device of claim 15, wherein the latch protrusions all have a rounded cross section.

17. The device of claim 14, further comprising:

a slot between each pair of adjacent sidewalls.

18. The device of claim 17, wherein the sidewalls are flexible, wherein the sidewalls apply a bias against the chain-link fence when the device is inserted into a fence opening.

* * * * *